US010140867B2

(12) United States Patent
Kodama et al.

(10) Patent No.: US 10,140,867 B2
(45) Date of Patent: Nov. 27, 2018

(54) COLLISION AVOIDANCE SYSTEM

(71) Applicant: The Yokohama Rubber Co., LTD., Minato-ku, Tokyo (JP)

(72) Inventors: Yuji Kodama, Hiratsuka (JP); Koji Nakatani, Hiratsuka (JP)

(73) Assignee: The Yokohama Rubber Co., Ltd. (JP)

( * ) Notice: Subject to any disclaimer, the term of this patent is extended or adjusted under 35 U.S.C. 154(b) by 0 days.

(21) Appl. No.: 15/539,670

(22) PCT Filed: Dec. 26, 2014

(86) PCT No.: PCT/JP2014/084563
§ 371 (c)(1),
(2) Date: Jun. 23, 2017

(87) PCT Pub. No.: WO2016/103460
PCT Pub. Date: Jun. 30, 2016

(65) Prior Publication Data

US 2017/0372609 A1 Dec. 28, 2017

(51) Int. Cl.
*G08G 1/16* (2006.01)
*G08G 1/0967* (2006.01)

(52) U.S. Cl.
CPC ..... *G08G 1/16* (2013.01); *G08G 1/0967* (2013.01)

(58) Field of Classification Search
CPC ..... B60R 21/013; B60Q 1/525; G08G 1/096791; G08G 1/162; G08G 1/0112;
(Continued)

(56) References Cited

U.S. PATENT DOCUMENTS 5,864,771 A * 1/1999 Yokoyama ..... B60K 31/0058 701/409
6,366,845 B1 * 4/2002 Kannonji ..... B60K 35/00 340/435
(Continued)

FOREIGN PATENT DOCUMENTS

JP H04-054600 2/1992
JP H04-236700 8/1992
(Continued)

OTHER PUBLICATIONS

International Search Report for International Application No. PCT/JP2014/084563 dated Mar. 31, 2015, 2 pages, Japan.

*Primary Examiner* — Hai Phan
*Assistant Examiner* — Son M Tang
(74) *Attorney, Agent, or Firm* — Thorpe North & Western

(57) ABSTRACT

A collision avoidance system comprises: a following vehicle data acquiring unit that acquires following vehicle data indicating the relative position and relative speed of a following vehicle traveling behind the host vehicle; a travel data acquiring unit that obtains travel data indicating travel conditions for the host vehicle; a specific state extraction unit that extracts specific travel data indicating specific travel conditions for the host vehicle under which the possibility of a collision between the host vehicle and the following vehicle is high; a database unit storing a plurality of pieces of specific travel data; a determination unit that determines whether or not there is the possibility of a collision between the host vehicle and the following vehicle; and a warning data output unit that outputs warning data to the following vehicle if the determination unit determines that there is the possibility of a collision.

3 Claims, 15 Drawing Sheets

(58) Field of Classification Search
CPC ..... G08G 1/166; B60W 50/0097; B60W 50/0098
See application file for complete search history.

(56) References Cited

U.S. PATENT DOCUMENTS

| | | | | |
|---|---|---|---|---|
| 6,405,132 | B1 * | 6/2002 | Breed | B60N 2/002 701/117 |
| 7,102,496 | B1 * | 9/2006 | Ernst, Jr. | G08G 1/096725 180/167 |
| 7,194,347 | B2 * | 3/2007 | Harumoto | B60R 21/0132 340/436 |
| 8,340,894 | B2 * | 12/2012 | Yester | G08G 1/163 340/436 |
| 8,531,318 | B2 * | 9/2013 | Denaro | B60W 10/06 340/425.5 |
| 9,132,775 | B2 * | 9/2015 | Ohama | G08G 1/16 |
| 9,283,968 | B2 * | 3/2016 | Yamada | B60W 50/0098 |
| 9,620,014 | B2 * | 4/2017 | Goudy | G08G 1/163 |
| 9,633,564 | B2 * | 4/2017 | Ferguson | G08G 1/166 |
| 9,658,620 | B1 * | 5/2017 | Urmson | G05D 1/0088 |
| 9,733,093 | B2 * | 8/2017 | Denaro | G01C 21/26 |
| 9,925,980 | B2 * | 3/2018 | Edo-Ros | B60W 30/0956 |
| 2002/0062189 | A1 * | 5/2002 | Kannonji | G08G 1/161 701/96 |
| 2004/0193347 | A1 | 9/2004 | Harumoto et al. | |
| 2005/0021224 | A1 * | 1/2005 | Gray | B60H 1/00771 701/36 |
| 2005/0080565 | A1 * | 4/2005 | Olney | B60K 31/0008 701/301 |
| 2007/0296564 | A1 * | 12/2007 | Howell | B60Q 1/525 340/435 |
| 2009/0140916 | A1 * | 6/2009 | Shamoto | G01S 19/43 342/357.31 |
| 2010/0209890 | A1 * | 8/2010 | Huang | G09B 9/05 434/65 |
| 2010/0253494 | A1 * | 10/2010 | Inoue | G01C 21/36 340/436 |
| 2012/0296562 | A1 * | 11/2012 | Carlson | B61L 15/0027 701/301 |
| 2013/0082874 | A1 * | 4/2013 | Zhang | G01S 5/0072 342/357.31 |
| 2013/0093614 | A1 * | 4/2013 | Tokoro | G01S 13/34 342/109 |
| 2015/0348412 | A1 * | 12/2015 | Onishi | G08G 1/096791 340/905 |

FOREIGN PATENT DOCUMENTS

| | | |
|---|---|---|
| JP | 2005-056372 | 3/2005 |
| JP | 2007-293592 | 11/2007 |
| JP | 2009-012498 | 1/2009 |
| JP | 2010-003086 | 1/2010 |
| JP | 2014-085711 | 5/2014 |

* cited by examiner

COLLISION AVOIDANCE SYSTEM

TECHNICAL FIELD

The present technology relates to a collision avoidance system.

BACKGROUND ART

In the technical field of collision avoidance systems whereby vehicles avoid collisions, technology is known in which a warning is issued to another vehicle when there is an increased possibility of a collision, as disclosed in Japanese Unexamined Patent Application Publication No. H04-054600A.

SUMMARY

A situation in which a following vehicle is about to collide with a host vehicle can be given as an example of a situation that frightens the driver of the host vehicle. Frightening situations often occur under similar driving circumstances. The probability of avoiding a collision can be increased if a warning can be issued while making use of such past frightening situations.

The present technology provides a collision avoidance system whereby collisions of vehicles are avoided by issuing a warning while making use of past frightening situations.

According an aspect of the present technology, a collision avoidance system is provided including: a following vehicle data acquiring unit, provided in a host vehicle, that acquires following vehicle data indicating a relative position and a relative speed, relative to the host vehicle, of a following vehicle traveling behind the host vehicle; a travel data acquiring unit, provided in the host vehicle, that acquires travel data indicating travel conditions of the host vehicle; a specific state extraction unit, provided in the host vehicle, that, on the basis of the following vehicle data and the travel data, extracts specific travel data indicating specific travel conditions for the host vehicle under which the possibility of a collision between the host vehicle and the following vehicle is high; a database unit, provided in the host vehicle, that stores a plurality of pieces of the specific travel data; a determination unit, provided in the host vehicle, that, on the basis of the travel data acquired by the travel data acquiring unit and the specific travel data stored in the database unit, determines whether or not there is the possibility of a collision between the host vehicle and the following vehicle; and a warning data output unit, provided in the host vehicle, that outputs warning data to the following vehicle upon the determination unit determining that there is the possibility of a collision.

According to an aspect, the collision avoidance system may further include a position data acquiring unit, provided in the host vehicle, which acquires position data indicating a position of the host vehicle. Here, on the basis of the following vehicle data, the position data, and the travel data, the specific state extraction unit may extract specific position data indicating a specific position of the host vehicle where the possibility of the specific travel conditions occurring is high; the database unit may store the specific travel data and the specific position data in association with each other; and the determination unit may determine whether or not there is the possibility of a collision between the following vehicle and the host vehicle on the basis of the position data acquired by the position data acquiring unit and the specific position data stored in the database unit.

According to an aspect of the present technology, a collision avoidance system is provided including: a following vehicle data acquiring unit, provided in a host vehicle, that acquires following vehicle data indicating a relative position and a relative speed, relative to the host vehicle, of a following vehicle traveling behind the host vehicle; a position data acquiring unit, provided in the host vehicle, that acquires position data indicating a position of the host vehicle; a specific state extraction unit, provided in the host vehicle, that, on the basis of the following vehicle data and the position data, extracts specific position data indicating a specific position of the host vehicle where the possibility of a collision between the host vehicle and the following vehicle is high; a database unit, provided in the host vehicle, that stores a plurality of pieces of the specific position data; a determination unit, provided in the host vehicle, that determines whether or not there is the possibility of a collision between the following vehicle and the host vehicle on the basis of the position data acquired by the position data acquiring unit and the specific position data stored in the database unit; and a warning data output unit, provided in the host vehicle, that outputs warning data to the following vehicle upon the determination unit determining that there is the possibility of a collision.

According to an aspect, the collision avoidance system may further include a distribution unit, provided in the host vehicle, which distributes the specific position data to another vehicle.

According to an aspect, the plurality of pieces of specific position data stored in the database unit may be classified on the basis of a level of the possibility of a collision; and the warning data output unit may change a timing at which to output the warning data on the basis of the level.

According to an aspect of the present technology, the collision avoidance system may further include: a driver identification data acquiring unit, provided in the host vehicle, that acquires driver identification data indicating a driver of the host vehicle; a time data acquiring unit, provided in the host vehicle, that acquires time data indicating a time; and a weather data acquiring unit, provided in the host vehicle, that acquires weather data indicating the weather. Here, the warning data output unit may change a timing at which to output the warning data on the basis of at least one of the driver identification data, the time data, and the weather data.

According to an aspect of the present technology, the plurality of pieces of specific position data stored in the database unit may be classified on the basis of a level of the possibility of a collision. The collision avoidance system may further include: a driver identification data acquiring unit, provided in the host vehicle, that acquires driver identification data indicating a driver of the host vehicle; a time data acquiring unit, provided in the host vehicle, that acquires time data indicating a time; and a weather data acquiring unit, provided in the host vehicle, that acquires weather data indicating the weather. Here, on the basis of at least one of the driver identification data, the time data, and the weather data, the determination unit may select the specific position data to use in the determination from the plurality of pieces of the specific position data stored in the database unit.

According to aspects of the present technology, a collision avoidance system whereby collisions of vehicles are avoided by issuing a warning while making use of past frightening situations is provided.

DETAILED DESCRIPTION

Embodiments according to the present technology will be described with reference to the drawings. However, the present technology is not limited to those embodiments. Constituents of the embodiments described below can be combined with one another as appropriate. In addition, there are also cases where some of the constituents are not used.

First Embodiment

Figure 1:
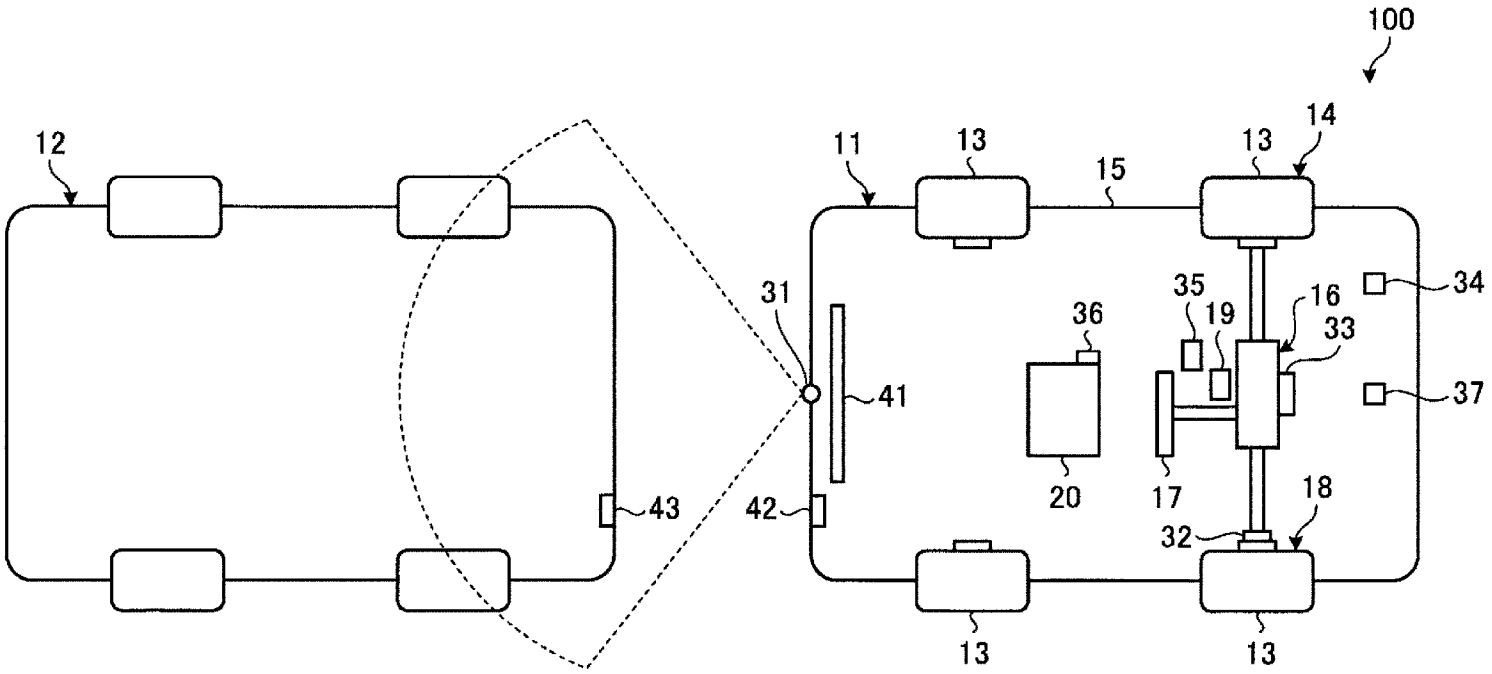
FIG. 1 is a schematic diagram illustrating an example of a collision avoidance system according to a first embodiment.

A first embodiment will now be described. FIG. 1 is a schematic diagram illustrating an example of a collision avoidance system 100 according to the present embodiment. The collision avoidance system 100 enables a host vehicle 11 and a following vehicle 12 traveling behind the host vehicle 11 to avoid a collision. The collision avoidance system 100 reduces damage caused by collisions between the host vehicle 11 and the following vehicle 12. The collision avoidance system 100 prevents collisions between the host vehicle 11 and the following vehicle 12. The collision avoidance system 100 is at least partially provided in the host vehicle 11.

The host vehicle 11 includes: a driving apparatus 14 including tires 13; a vehicle body 15 supported by the driving apparatus 14; a steering apparatus 16 that enables an advancement direction of the host vehicle 11 to be changed; a steering operation unit 17 for operating the steering apparatus 16; a brake apparatus 18 for slowing or stopping the host vehicle 11; a brake operation unit 19 for operating the brake apparatus 18; and a control device 20 that controls the host vehicle 11. The control device 20 includes a computer system such as an Engine Control Unit (ECU).

Additionally, the host vehicle 11 includes: a following vehicle sensor 31 that detects the following vehicle 12 in a non-contact manner; a speed sensor 32 that detects a travel speed of the host vehicle 11; a steering sensor 33 that detects a steering angle and steering speed of the steering apparatus 16; a GPS receiver 34 that detects the position of the host vehicle 11; an identification data input device 35 into which identification data of the driver of the host vehicle 11 is inputted; a timer 36 that measures time; and a rain sensor 37 that detects rain.

The host vehicle 11 further includes a warning device 41 that issues a warning to the following vehicle 12, and a wireless communication device 42.

The host vehicle 11 has a driver cab that a driver occupies. The steering operation unit 17 and the brake operation unit 19 are disposed in the driver cab. The steering operation unit 17 and the brake operation unit 19 are operated by the driver. The steering operation unit 17 includes a steering wheel. The brake operation unit 19 includes a brake pedal.

The following vehicle sensor 31 detects the following vehicle 12 behind the host vehicle 11 in a non-contact manner. The following vehicle sensor 31 is disposed in a rear part of the vehicle body 15 of the host vehicle 11. The following vehicle sensor 31 includes a radar device. The radar device may be a millimeter wave radar device or a Doppler radar device. The radar device is capable of detecting the presence/absence of the following vehicle 12 traveling behind the host vehicle 11 by emitting radio waves or ultrasonic waves. In addition to the presence/absence of the following vehicle 12, the radar device is capable of detecting a relative position relative to the host vehicle 11 of the following vehicle 12 and a relative speed relative to the host vehicle 11 of the following vehicle 12. The relative position relative to the host vehicle 11 of the following vehicle 12 includes the relative distance and orientation. Note that the following vehicle sensor 31 may include at least one of a laser scanner and a three-dimensional rangefinder. The following vehicle sensor 31 may include a camera capable of detecting an object in a non-contact manner by capturing an optical image of the object.

The warning device 41 issues a warning to the following vehicle 12 using sound, an image, or both. The warning device 41 is disposed in a rear part of the vehicle body 15. The wireless communication device 42 is capable of communicating wirelessly with a wireless communication device 43 provided in the following vehicle 12.

Figure 2:
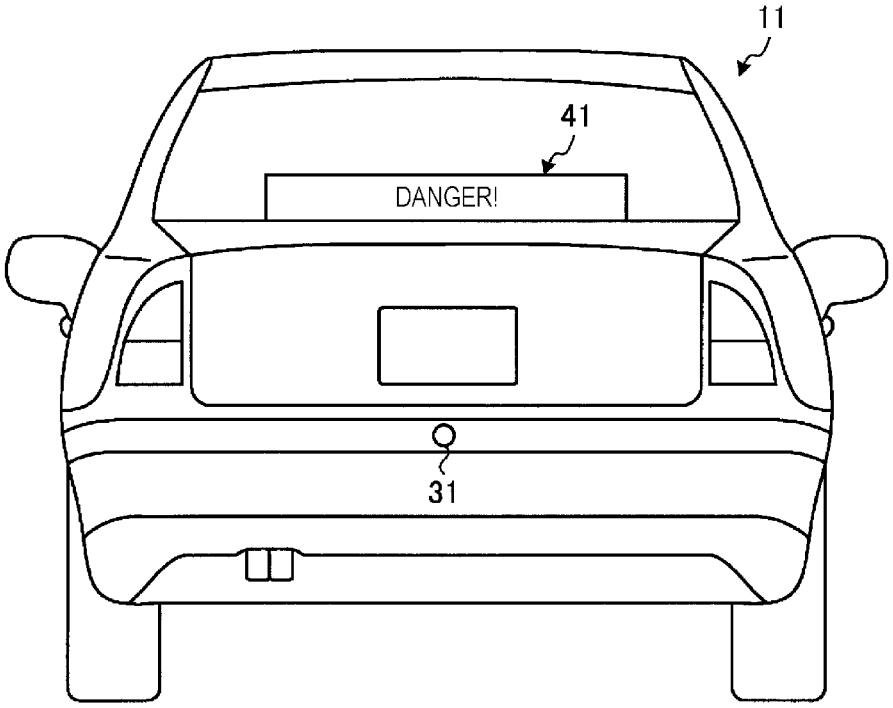
FIG. 2 is a schematic diagram illustrating an example of a host vehicle according to the first embodiment.

FIG. 2 is a diagram illustrating an example of the host vehicle 11 according to the present embodiment from the rear. As illustrated in FIG. 2, the following vehicle sensor 31 is provided in a rear part of the host vehicle 11. The warning device 41 is provided in a rear part of the host vehicle 11. In the present embodiment, the warning device 41 includes a display device provided on an inner side of the rear window (that is, on the inside) of the host vehicle 11. The warning device 41 is provided in a position visible to the driver of the following vehicle 12. In the example illustrated in FIG. 2, the warning device 41 issues a warning to the driver of the following vehicle 12 by displaying text data reading "DANGER!". Note that the warning device 41 may include a speaker. The warning device 41 may issue a warning to the following vehicle 12 using audio.

Figure 3:
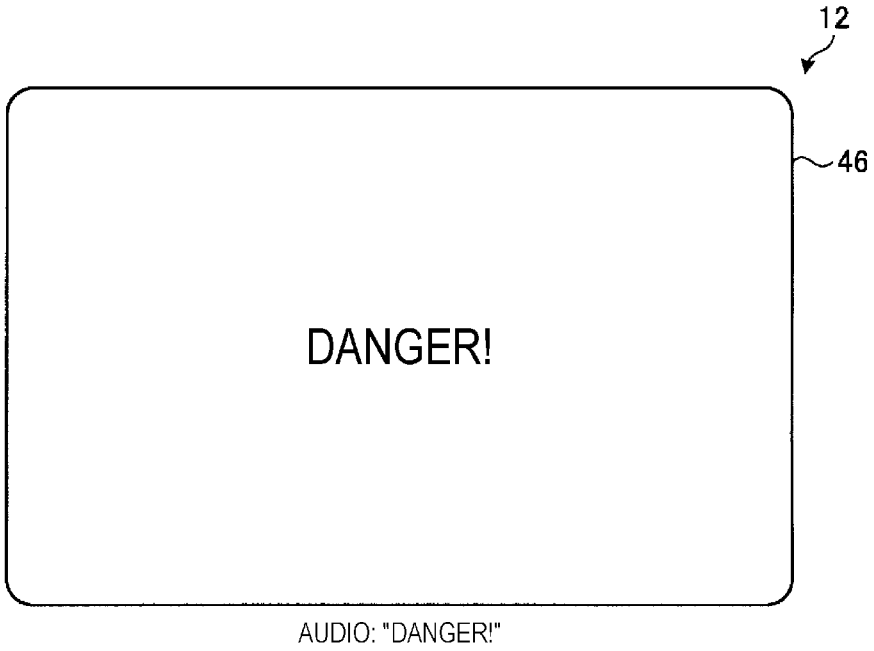
FIG. 3 is a schematic diagram illustrating part of a following vehicle according to the first embodiment.

FIG. 3 is a diagram schematically illustrating an example of a display device 46 provided in the driver cab of the following vehicle 12 according to the present embodiment. Using the wireless communication device 42, the host vehicle 11 is capable of communicating wirelessly with the wireless communication device 43 provided in the following vehicle 12. The host vehicle 11 can issue a warning to the following vehicle 12 through the wireless communication device 43. In the case where the host vehicle 11 issues a warning to the driver of the following vehicle 12, warning data is sent to the following vehicle 12 from the control device 20 of the host vehicle 11 through the wireless communication device 42 and the wireless communication device 43. A control device of the following vehicle 12 controls the display device 46 provided in the driver cab of the following vehicle 12 on the basis of the warning data supplied from the host vehicle 11. In the example illustrated in FIG. 2, the display device 46 of the following vehicle 12 issues a warning to the driver of the following vehicle 12 by displaying text data reading "DANGER!". Note that the control device of the following vehicle 12 may control a speaker provided in the driver cab of the following vehicle 12 on the basis of the warning data supplied from the host vehicle 11. For example, audio data saying "danger!" may be outputted to the driver of the following vehicle 12 from the speaker.

Figure 4:
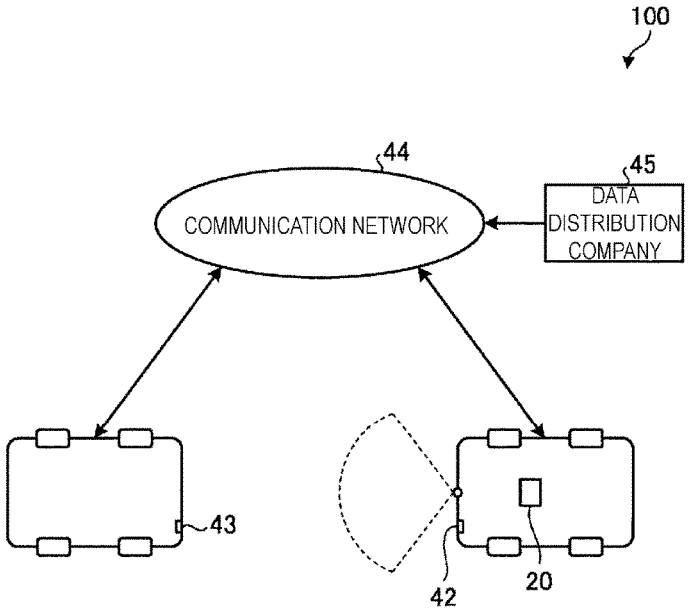
FIG. 4 is a schematic diagram illustrating an example of the collision avoidance system according to the first embodiment.

FIG. 4 is a diagram schematically illustrating the collision avoidance system 100 according to the present embodiment. The host vehicle 11 can communicate with the following vehicle 12 over a communication network 44. The host vehicle 11 may communicate directly with the wireless communication device 43 provided in the following vehicle 12, or may communicate with the following vehicle 12 over the communication network 44. For example, the warning data outputted from the control device 20 of the host vehicle 11 may be sent to the control device of the following vehicle 12 over the communication network 44. Additionally, the host vehicle 11 can receive data distributed from a data distribution company 45 over the communication network 44. The data distribution company 45 distributes weather data, for example.

Figure 5:
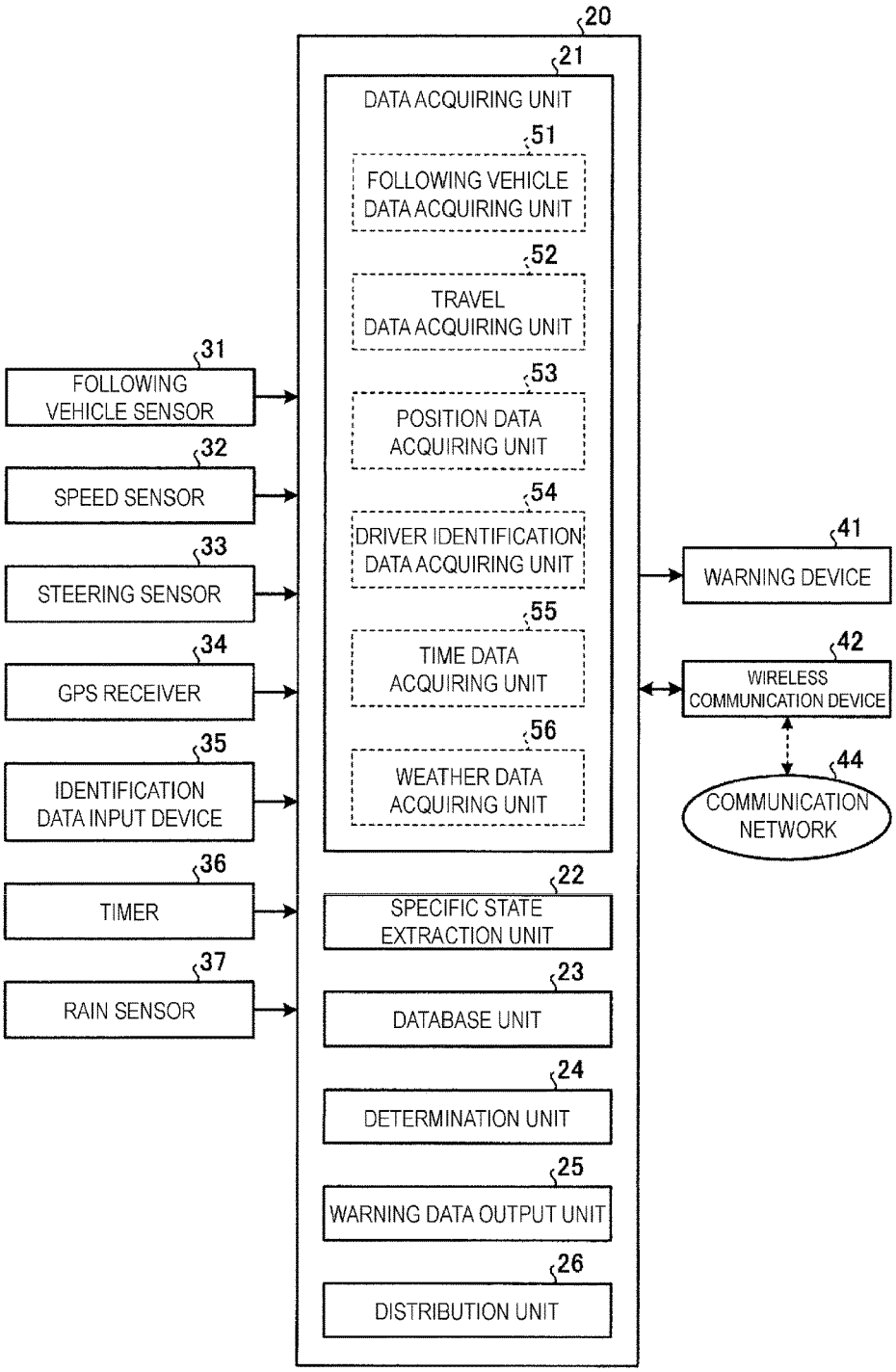
FIG. 5 is a function block diagram illustrating an example of the collision avoidance system according to the first embodiment.

FIG. 5 is a function block diagram illustrating an example of the collision avoidance system 100 according to the present embodiment. The control device 20 is provided in the host vehicle 11. The control device 20 includes a computer system. The computer system has a processor, such as a CPU (Central Processing Unit), ROM (Read-Only Memory), RAM (Random-Access Memory), and a storage device such as a hard disk. As illustrated in FIG. 5, the control device 20 includes a data acquiring unit 21, a specific state extraction unit 22, a database unit 23, a determination unit 24, a warning data output unit 25, and a distribution unit 26.

The data acquiring unit 21 acquires data. In the present embodiment, the data acquiring unit 21 includes: a following vehicle data acquiring unit 51 that acquires following vehicle data indicating a relative position and a relative speed, relative to the host vehicle 11, of the following vehicle 12; a travel data acquiring unit 52 that acquires travel data indicating travel conditions of the host vehicle 11; a position data acquiring unit 53 that acquires position data indicating the position of the host vehicle 11; a driver identification data acquiring unit 54 that acquires driver identification data indicating the driver of the host vehicle 11; a time data acquiring unit 55 that acquires time data indicating the time; and a weather data acquiring unit 56 that acquires weather data indicating the weather.

The following vehicle data acquiring unit 51 acquires the following vehicle data indicating the relative position and relative speed relative to the host vehicle 11 of the following vehicle 12 from the following vehicle sensor 31. The following vehicle sensor 31 detects the following vehicle data indicating the relative position and relative speed relative to the host vehicle 11 of the following vehicle 12, and sends that data to the following vehicle data acquiring unit 51.

The travel data acquiring unit 52 acquires the travel data indicating the travel conditions of the host vehicle 11 from the speed sensor 32 and the steering sensor 33. The travel conditions of the host vehicle 11 include the travel speed, acceleration, deceleration (negative acceleration), and advancement direction. The speed sensor 32 can detect the travel speed, acceleration, and deceleration (negative acceleration) of the host vehicle 11. The steering sensor 33 can detect the advancement direction of the host vehicle 11. The steering sensor 33 can also detect a steering angle and steering speed of the steering apparatus 16. "Steering speed" is the speed at which the steering apparatus 16 moves. The steering speed includes a speed at which the driver has moved the steering operation unit 17. The speed sensor 32 detects the travel data of the host vehicle 11, including the travel speed, acceleration, and deceleration (negative acceleration) of the host vehicle 11, and sends that data to the travel data acquiring unit 52. The steering sensor 32 detects the travel data of the host vehicle 11, including the steering angle and steering speed, and sends that data to the travel data acquiring unit 52.

The position data acquiring unit 53 acquires the position data, indicating the position of the host vehicle 11, from the GPS receiver 34. The position of the host vehicle 11 is an absolute position on the earth as specified by a Global Positioning System (GPS). The GPS receiver 34 receives a signal from GPS satellites, and derives the position data indicating the position of the host vehicle 11. The GPS receiver 34 derives the position data, indicating the position of the host vehicle 11, and sends that data to the position data acquiring unit 53.

The driver identification data acquiring unit 54 acquires the driver identification data, indicating the driver of the host vehicle 11, from the identification data input device 35. The driver carries an identification member such as an ID card or an ID key. The identification member holds driver identification data unique to that driver. The driver causes the identification data input device 35 to read the driver identification data held in the identification member upon entering the driver cab. As a result, the identification data input device 35 acquires the driver identification data. The identification data input device 35 acquires the driver identification data, indicating the driver of the host vehicle 11, and sends that data to the driver identification data acquiring unit 54.

In the present embodiment, the engine of the host vehicle 11 is started in response to the driver identification data being inputted into the identification data input device 35. The engine of the host vehicle 11 is prohibited from starting when the driver identification data is not inputted into the identification data input device 35. The host vehicle 11 may be a vehicle belonging to a transport company such as a freight shipping company, a bus company, or a taxi company, and thus a single host vehicle 11 may be alternately driven by a plurality of drivers. The engine of the host vehicle 11 starts in response to the driver identification data being read by the identification data input device 35. A driver not belonging to the transport company is prevented from moving the host vehicle 11.

The time data acquiring unit 55 acquires the time data, indicating the time, from the timer 36. The timer 36 sends the time data, indicating the time, to the time data acquiring unit 55.

The weather data acquiring unit 56 acquires the weather data, indicating the weather, from the rain sensor 37. In the case where rain is detected, the rain sensor 37 sends weather data indicating rainy weather to the weather data acquiring unit 56. In the case where rain is not detected, the rain sensor 37 sends weather data indicating clear weather to the weather data acquiring unit 56. Note that the weather data acquiring unit 56 may acquire weather data distributed by the data distribution company 45 over the communication network 44.

The specific state extraction unit 22 extracts specific travel data indicating specific travel conditions of the host vehicle 11 under which the host vehicle 11 and the following vehicle 12 are likely to collide, on the basis of the following vehicle data and the travel data acquired by the data acquiring unit 21. Additionally, the specific state extraction unit 22 extracts specific position data indicating a specific position of the host vehicle 11 where the host vehicle 11 and the following vehicle 12 are likely to collide, on the basis of the following vehicle data and the position data acquired by the data acquiring unit 21. Additionally, the specific state extraction unit 22 can extract specific position data indicating a specific position of the host vehicle 11 where the specific travel conditions are likely to arise, on the basis of the following vehicle data, the position data, and the travel data.

Figure 6:
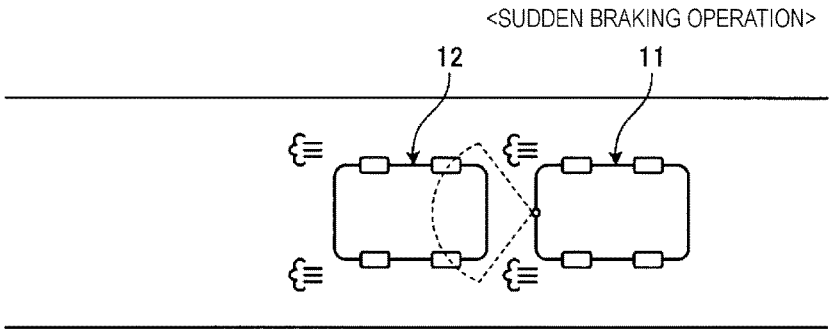
FIG. 6 is a schematic diagram illustrating an example of a situation in which a host vehicle and a following vehicle are about to collide.
Figure 7:
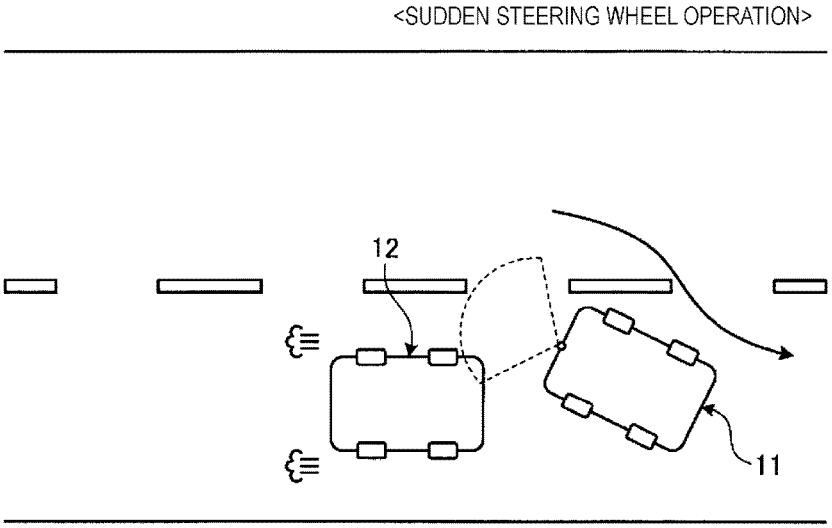
FIG. 7 is a schematic diagram illustrating an example of a situation in which a host vehicle and a following vehicle are about to collide.

FIGS. 6 and 7 are schematic diagrams illustrating examples of the specific travel conditions. The specific travel conditions are travel conditions of the host vehicle 11 under which it is likely that the host vehicle 11 will be rear-ended by the following vehicle 12. The travel conditions of the host vehicle 11 include driving conditions of the driver of the host vehicle 11.

The specific travel conditions are travel conditions that lead to a rear-end collision in which the following vehicle 12 rear-ends the host vehicle 11. The specific driving conditions of the driver of the host vehicle 11 are driving conditions that lead to a rear-end collision in which the following vehicle 12 rear-ends the host vehicle 11. The specific driving conditions of the driver of the host vehicle 11 include a sudden braking operation in which the driver of the host vehicle 11 suddenly operates the brake operation unit 19, and a sudden steering wheel operation in which the driver of the host vehicle 11 suddenly operates the steering operation unit 17.

For example, the likelihood of the host vehicle 11 being rear-ended by the following vehicle 12 increases when a sudden braking operation is carried out in the host vehicle 11 and the host vehicle 11 brakes suddenly, as illustrated in FIG. 6. FIG. 6 illustrates a situation in which a sudden braking operation is carried out in the host vehicle 11 while the host vehicle 11 and the following vehicle 12 are traveling in the same lane, and the host vehicle 11 is about to be rear-ended by the following vehicle 12.

Likewise, the likelihood of the host vehicle 11 being rear-ended by the following vehicle 12 increases when a sudden steering wheel operation is carried out in the host vehicle 11 and the advancement direction of the host vehicle 11 changes suddenly, as illustrated in FIG. 7. FIG. 7 illustrates a situation in which a sudden steering wheel operation is carried out in the host vehicle 11 while the host vehicle 11 and the following vehicle 12 are traveling in different lanes, and the host vehicle 11 suddenly enters the lane in which the following vehicle 12 is traveling and is about to be rear-ended by the following vehicle 12.

In the present embodiment, when, due to the travel conditions of the host vehicle 11 including the driving conditions of the driver, the relative speed relative to the host vehicle 11 of the following vehicle 12 has become greater than or equal to a predetermined speed and the relative distance relative to the host vehicle 11 of the following vehicle 12 has become less than or equal to a predetermined distance, the specific state extraction unit 22 determines that the driver of the host vehicle 11 is engaging in specific driving (dangerous driving) and that the host vehicle 11 is undergoing specific travel (dangerous travel).

The following vehicle data indicating the relative speed and relative distance relative to the host vehicle 11 of the following vehicle 12 is detected by the following vehicle sensor 31. A degree of a sudden drop in the travel speed of the host vehicle 11 (a degree of deceleration), including a degree of the sudden braking operation made by the driver of the host vehicle 11, is detected by the speed sensor 32. A degree of a sudden change in the advancement direction of the host vehicle 11, including a degree of the sudden steering wheel operation made by the driver of the host vehicle 11, is detected by the steering sensor 33. The specific state extraction unit 22 determines whether or not the host vehicle 11 is undergoing the specific travel, including the specific driving, on the basis of the detection result from the following vehicle sensor 31, the detection result from the speed sensor 32, and the detection result from the steering sensor 33.

The specific state extraction unit 22 determines whether or not the host vehicle 11 that is traveling has undergone the specific travel, on the basis of the following vehicle data acquired by the following vehicle data acquiring unit 51 and the travel data acquired by the travel data acquiring unit 52. The specific state extraction unit 22 extracts the specific travel data (dangerous travel data) indicating that the host vehicle 11 has undergone the specific travel.

When it is determined, on the basis of the detection result from the following vehicle sensor 31, that the following vehicle 12 has suddenly and abnormally approached the traveling host vehicle 11 and is about to rear-end the host vehicle 11, the specific state extraction unit 22 extracts the travel data of the host vehicle 11 at the time of that determination as the specific travel data. The specific travel data extracted by the specific state extraction unit 22 is stored in the database unit 23.

Figure 8:
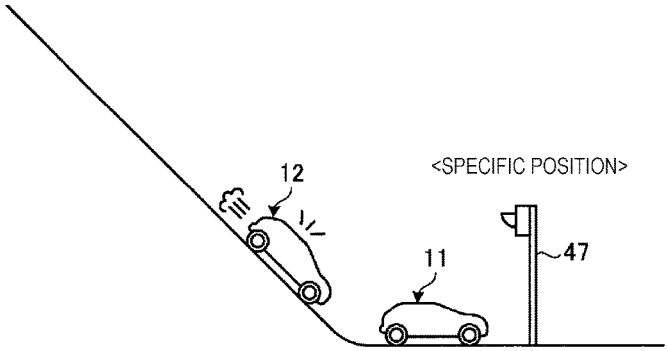
FIG. 8 is a schematic diagram illustrating an example of a situation in which a host vehicle and a following vehicle are about to collide.
Figure 9:
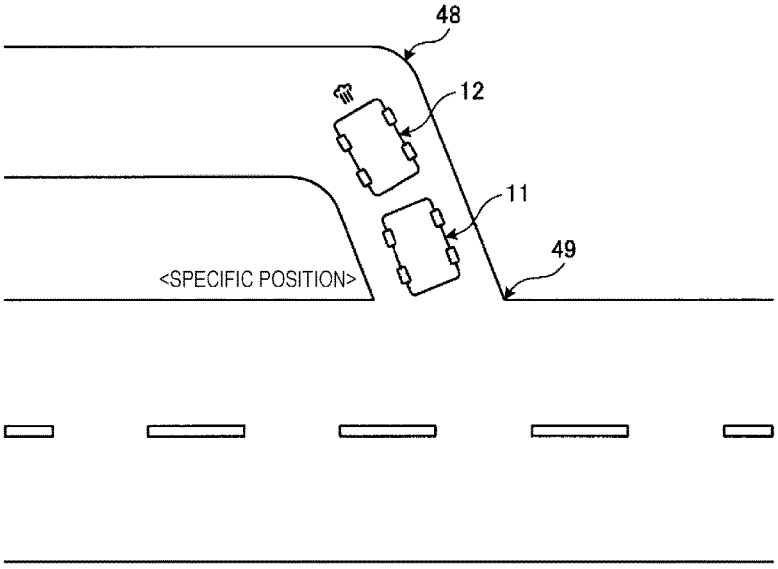
FIG. 9 is a schematic diagram illustrating an example of a situation in which a host vehicle and a following vehicle are about to collide.

FIGS. 8 and 9 are schematic diagrams illustrating examples of the specific position. The specific position is a position of the host vehicle 11 where it is likely that the host vehicle 11 will be rear-ended by the following vehicle 12.

There are positions on a road traveled on by the host vehicle 11 where rear-end collisions are more likely to occur.

For example, as illustrated in FIG. 8, in the case where a traffic signal 47 is present at the end of a downward slope in the road, and the host vehicle 11 is stopped in compliance with an instruction from the traffic signal 47, it is possible that the following vehicle 12 traveling down the downward slope will collide with the host vehicle 11. In the example illustrated in FIG. 8, the position where the traffic signal 47 is provided corresponding to the specific position.

Additionally, as illustrated in FIG. 9, in the case where an intersection 49 for merging with a main road is present in front of a curve 48 in a road with poor visibility, and the host vehicle 11 is stopped before the intersection 49 in order to enter the main road, it is possible that the following vehicle 12 traveling through the curve 48 will collide with the host vehicle 11. In the example illustrated in FIG. 9, the position before the intersection 49 corresponds to the specific position.

Note that in FIGS. 8 and 9, it is less likely that the following vehicle 12 will collide with the host vehicle 11 in the case where the driver of the following vehicle 12 is a driver accustomed to the road on which the specific position is present, is a driver local to the area, or is an experienced driver. On the other hand, it is more likely that the following vehicle 12 will collide with the host vehicle 11 in the case where the driver of the following vehicle 12 is a driver unaccustomed to the road on which the specific position is present, is a driver foreign to the area and is using that road for the first time, or is an inexperienced driver.

In the present embodiment, when, due to the position of the host vehicle 11, the relative speed relative to the host vehicle 11 of the following vehicle 12 has become greater than or equal to a predetermined speed and the relative distance relative to the host vehicle 11 of the following vehicle 12 has become less than or equal to a predetermined distance, the specific state extraction unit 22 determines that the position where the host vehicle 11 is present is a specific position (a dangerous position). The following vehicle data indicating the relative speed and relative distance relative to the host vehicle 11 of the following vehicle 12 is detected by the following vehicle sensor 31. The position of the host vehicle 11 is acquired by the GPS receiver 34.

The specific state extraction unit 22 determines whether or not the position of the host vehicle 11 that is stopped is the specific position, on the basis of the following vehicle data acquired by the following vehicle data acquiring unit 51 and the position data acquired by the position data acquiring unit 53. The specific state extraction unit 22 extracts the specific position data (dangerous position data) indicating that the position of the host vehicle 11 is the specific position.

When it is determined, on the basis of the detection result from the following vehicle sensor 31, that the following vehicle 12 has suddenly and abnormally approached the stopped host vehicle 11 and is about to rear-end the host vehicle 11, the specific state extraction unit 22 extracts the position data of the host vehicle 11 at the time of that determination as the specific position data. The specific position data extracted by the specific state extraction unit 22 is stored in the database unit 23.

In the examples described with reference to FIGS. 8 and 9, when it is determined that the following vehicle 12 has suddenly and abnormally approached the stopped host vehicle 11 and is about to rear-end the host vehicle 11, the position data of the host vehicle 11 at the time of that determination is extracted as the specific position data.

Figure 10:
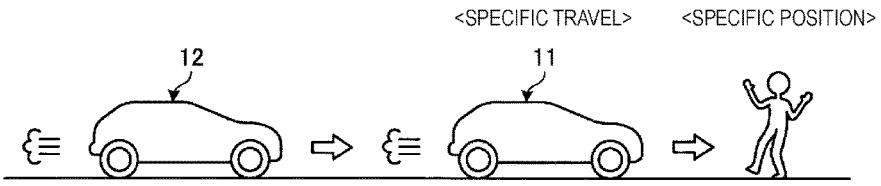
FIG. 10 is a schematic diagram illustrating an example of a situation in which a host vehicle and a following vehicle are about to collide.

A situation in which a pedestrian has jumped into the road can be thought of as a situation in which the following vehicle 12 is about to collide with the host vehicle 11 that is traveling, as illustrated in FIG. 10. For example, near schools or parks, it is possible that a child will jump into the road. It is also possible that a pedestrian will jump into the road during the morning rush hour. When the host vehicle 11 that is traveling approaches a position where pedestrians often jump into the road, it is possible that the driver of the host vehicle 11 that is traveling will make a sudden braking operation or a sudden steering wheel operation in response to a pedestrian jumping into the road. As a result, there is an increased possibility that the following vehicle 12 traveling behind the host vehicle 11 will rear-end the host vehicle 11 that is traveling.

The specific state extraction unit 22 may extract specific position data indicating a specific position of the host vehicle 11 where the specific travel conditions are likely to arise, on the basis of the following vehicle data acquired by the following vehicle data acquiring unit 51, the position data acquired by the position data acquiring unit 53, and the travel data acquired by the travel data acquiring unit 52.

When it is determined, on the basis of the detection result from the following vehicle sensor 31, that the following vehicle 12 has suddenly and abnormally approached the traveling host vehicle 11 and is about to rear-end the host vehicle 11, the specific state extraction unit 22 may extract the travel data of the host vehicle 11 at the time of that determination as the specific travel data, and may extract the position of the host vehicle 11 when that specific travel was carried out as the specific position data of the host vehicle 11 where the specific travel conditions are likely to arise. The specific travel data and the specific position data of the host vehicle 11 at the time that determination is made are stored in association with each other in the database unit 23.

The database unit 23 stores a plurality of pieces of the specific travel data extracted by the specific state extraction unit 22. The database unit 23 stores a plurality of pieces of the specific position data extracted by the specific state extraction unit 22. The database unit 23 may store the specific travel data and the specific position data in association with each other.

The specific state extraction unit 22 extracts a plurality of pieces of the specific travel data of the host vehicle 11 for the time at which it is determined that the following vehicle 12 is about to rear-end the host vehicle 11 that is traveling. By storing a plurality of patterns of the specific travel data in the database unit 23, a database of a plurality of patterns of the specific travel data of the host vehicle 11 in which it is likely that the host vehicle 11 and the following vehicle 12 will collide is created. A database of specific driving data of the driver of the host vehicle 11 that leads to a rear-end collision in which the following vehicle 12 rear-ends the host vehicle 11 may be created.

The specific state extraction unit 22 extracts a plurality of pieces of the specific position data of the host vehicle 11 for the time at which it is determined that the following vehicle 12 is about to rear-end the host vehicle 11 that is stopped. By storing a plurality of patterns of the specific position data in the database unit 23, a database of a plurality of patterns of the specific position data of the host vehicle 11 in which it is likely that the host vehicle 11 and the following vehicle 12 will collide is created.

The specific state extraction unit 22 may extract, in association with each other, a plurality of pieces of the specific position data and the specific travel data of the host vehicle 11 for the time at which it is determined that the following vehicle 12 is about to rear-end the host vehicle 11 that is traveling. By storing a plurality of associated patterns of the specific travel data of the host vehicle 11 and the specific position data of the host vehicle 11 in the database unit 23, a database of a plurality of patterns of the specific travel data of the host vehicle 11 and the specific position data of the host vehicle 11 in which it is likely that the host vehicle 11 and the following vehicle 12 will collide is created.

After the database of the specific travel data has been constructed, the determination unit 24 determines whether or not it is possible that the host vehicle 11 and the following vehicle 12 will collide on the basis of the travel data acquired by the travel data acquiring unit 52 and the database of the specific travel data stored in the database unit 23. The warning data output unit 25 outputs the warning data to the following vehicle 12 upon the determination unit 24 determining that a collision is possible.

Figure 11:
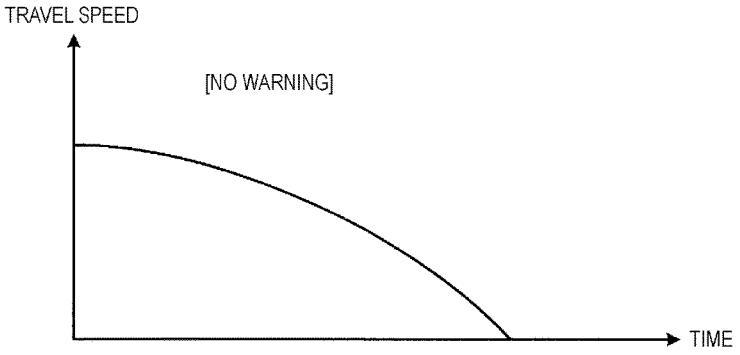
FIG. 11 is a diagram illustrating an example of a collision avoidance method according to the first embodiment.
Figure 12:
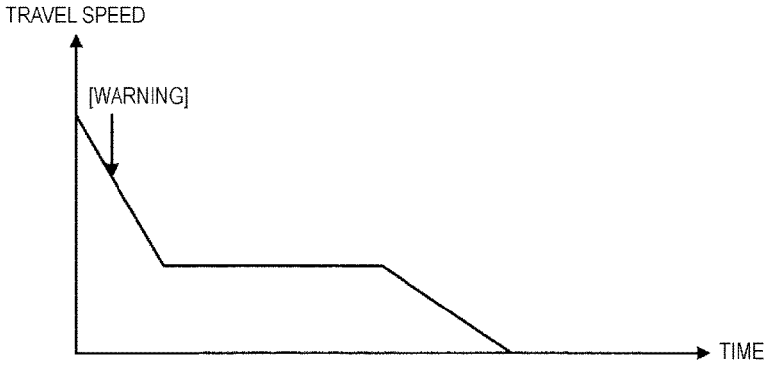
FIG. 12 is a diagram illustrating an example of a collision avoidance method according to the first embodiment.

FIGS. 11 and 12 are diagrams illustrating an example of operations of the determination unit 24 and the warning data output unit 25. A database of the specific travel data of the host vehicle 11 in which the following vehicle 12 is likely to rear-end the host vehicle 11 is stored in the database unit 23. The determination unit 24 determines whether or not it is possible that the host vehicle 11 and the following vehicle 12 will collide on the basis of the travel data acquired by the travel data acquiring unit 52 and the database of the specific travel data stored in the database unit 23.

FIG. 11 is a schematic diagram illustrating an example of a relationship between the travel speed of the host vehicle 11 and time in the case where a proper braking operation is carried out rather than a sudden braking operation that can lead to a rear-end collision. In the case where, on the basis of the travel data acquired by the travel data acquiring unit 52 and the database of the specific travel data stored in the database unit 23, the determination unit 24 has determined that the host vehicle 11 has not made a sudden braking operation and that there is no possibility of a collision between the host vehicle 11 and the following vehicle 12, the warning data output unit 25 does not output the warning data. Likewise, in the case where, on the basis of the travel data acquired by the travel data acquiring unit 52 and the database of the specific travel data stored in the database unit 23, the determination unit 24 has determined that the host vehicle 11 has not made a sudden steering wheel operation and that there is no possibility of a collision between the host vehicle 11 and the following vehicle 12, the warning data output unit 25 does not output the warning data.

FIG. 12 is a schematic diagram illustrating an example of a relationship between the travel speed of the host vehicle 11 and time in the case where a sudden braking operation that can lead to a rear-end collision has been made. In the case where, on the basis of the travel data acquired by the travel data acquiring unit 52 and the database of the specific travel data stored in the database unit 23, the determination unit 24 has determined that the host vehicle 11 has made a sudden braking operation that can lead to a rear-end collision and that a collision between the host vehicle 11 and the following vehicle 12 is possible, the warning data output unit 25 outputs the warning data. Likewise, in the case where, on the basis of the travel data acquired by the travel data acquiring unit 52 and the database of the specific travel data stored in the database unit 23, the determination unit 24 has determined that the host vehicle 11 has made a sudden steering wheel operation that can lead to a rear-end collision and that a collision between the host vehicle 11 and the following vehicle 12 is possible, the warning data output unit 25 outputs the warning data.

The warning data outputted by the warning data output unit 25 is supplied to the warning device 41. As a result, the warning device 41 operates as described with reference to FIG. 2. The warning data outputted from the warning data output unit 25 may be supplied to the control device of the following vehicle 12 through the wireless communication device 42 and the wireless communication device 43. As a result, the display device 46 operates as described with reference to FIG. 3. The attention of the driver of the following vehicle 12 is caught by the warning device 41 or the display device 46 operating. The driver of the following vehicle 12 can thus take actions to avoid colliding with the host vehicle 11. The driver of the following vehicle 12 can apply the brakes early, change lanes to a different lane from the lane in which the host vehicle 11 is traveling, or the like in order to avoid colliding with the host vehicle 11.

In the present embodiment, even when there is no following vehicle 12 behind the host vehicle 11, in the case where, on the basis of the travel data of the host vehicle 11 acquired by the travel data acquiring unit 52 and the database of the specific travel data stored in the database unit 23, the determination unit 24 has determined that the host vehicle 11 has made a sudden steering wheel operation or a sudden braking operation that can lead to a rear-end collision, the warning data output unit 25 is caused to output the warning data.

Additionally, the determination unit 24 determines whether or not it is possible that the host vehicle 11 and the following vehicle 12 will collide on the basis of the position data acquired by the position data acquiring unit 53 and the database of the specific position data stored in the database unit 23. The warning data output unit 25 outputs the warning data to the following vehicle 12 upon the determination unit 24 determining that a collision is possible.

Figure 13:
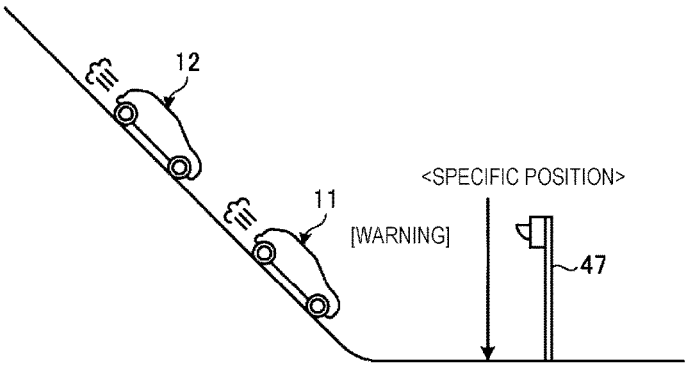
FIG. 13 is a diagram illustrating an example of a collision avoidance method according to the first embodiment.
Figure 14:
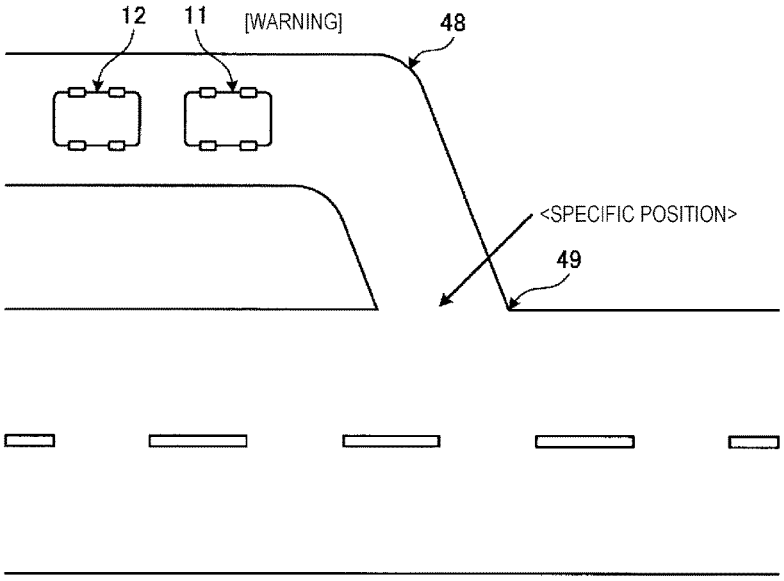
FIG. 14 is a diagram illustrating an example of a collision avoidance method according to the first embodiment.

FIGS. 13 and 14 are diagrams illustrating an example of operations of the determination unit 24 and the warning data output unit 25. As described above, a database of the specific position data of the host vehicle 11 in which the following vehicle 12 is likely to rear-end the host vehicle 11 is stored in the database unit 23. The determination unit 24 determines whether or not it is possible that the host vehicle 11 and the following vehicle 12 will collide on the basis of the position data acquired by the position data acquiring unit 53 and the database of the specific position data stored in the database unit 23.

FIG. 13 is a schematic diagram illustrating an example in which the host vehicle 11 approaches a specific position where a rear-end collision is likely to occur. In the case where, on the basis of the position data acquired by the position data acquiring unit 53 and the database of the specific position data stored in the database unit 23, it has been determined that a distance between the current position of the host vehicle 11 traveling toward the specific position where a rear-end collision is likely to occur and that specific position is less than or equal to a predetermined threshold value, the determination unit 24 determines that a collision between the host vehicle 11 and the following vehicle 12 is possible. Note that the current position of the host vehicle 11 is acquired by the position data acquiring unit 53 on the basis of a detection result from the GPS receiver 34. The specific position is stored in the database unit 23. The determination unit 24 can determine the distance between the current position of the host vehicle 11 and the specific position on the basis of the current position of the host vehicle 11 acquired by the position data acquiring unit 53 and the database of the specific position data stored in the database unit 23. In the case where the determination unit 24 has determined that a collision between the host vehicle 11 and the following vehicle 12 is possible, the warning data output unit 25 outputs the warning data. The warning data output unit 25 outputs the warning data before the host vehicle 11 reaches the specific position.

FIG. 14 is a schematic diagram illustrating an example in which the host vehicle 11 approaches a specific position where a rear-end collision is likely to occur. In the case where, on the basis of the position data acquired by the position data acquiring unit 53 and the specific position data stored in the database unit 23, the determination unit 24 has determined that the distance between the current position of the host vehicle 11 traveling toward the specific position where a rear-end collision is likely to occur and that specific position is less than or equal to the predetermined threshold value, the warning data output unit 25 outputs the warning data. The warning data output unit 25 outputs the warning data before the host vehicle 11 reaches the specific position.

The warning data outputted by the warning data output unit 25 is supplied to the warning device 41. As a result, the warning device 41 operates as described with reference to FIG. 2. The warning data outputted from the warning data output unit 25 may be supplied to the control device of the following vehicle 12 through the wireless communication device 42 and the wireless communication device 43. As a result, the display device 46 operates as described with reference to FIG. 3. The attention of the driver of the following vehicle 12 is caught by the warning device 41 or the display device 46 operating. The driver of the following vehicle 12 can thus take actions to avoid colliding with the host vehicle 11.

In the present embodiment, even when there is no following vehicle 12 behind the host vehicle 11, in the case where, on the basis of the position data of the host vehicle 11 acquired by the position data acquiring unit 53 and the database of the specific position data stored in the database unit 23, the determination unit 24 has determined that the host vehicle 11 is approaching a specific position where a rear-end collision is likely to occur, the warning data output unit 25 is caused to output the warning data.

Figure 15:
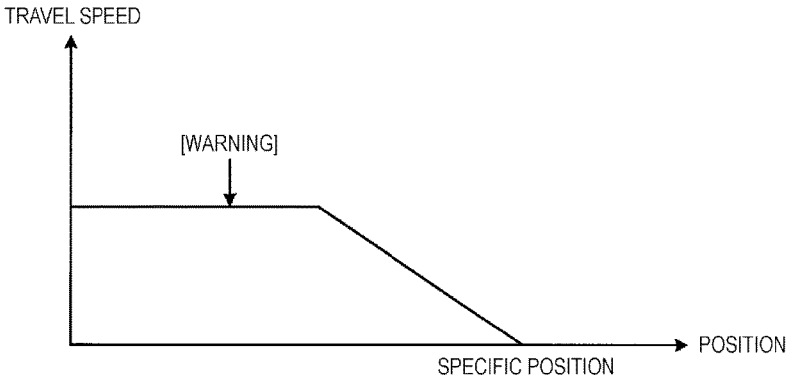
FIG. 15 is a diagram illustrating an example of a collision avoidance method according to the first embodiment.

FIG. 15 is a schematic diagram illustrating an example of a relationship between the travel speed of the host vehicle 11 and the position of the host vehicle 11 when the host vehicle 11 is approaching a specific position where a rear-end collision is likely to occur. The driver of the host vehicle 11 applies the brakes appropriately in order to stop at the specific position, such as the position of the traffic signal 47 or the position of the intersection 49. As a result, the travel speed of the host vehicle 11 decreases as the host vehicle 11 approaches the specific position, as illustrated in FIG. 15.

In the present embodiment, upon determining that the distance between the current position of the host vehicle 11 and the specific position is less than or equal to the predetermined threshold value before the driver of the host vehicle 11 has applied the brakes, the determination unit 24 causes the warning data to be outputted from the warning data output unit 25. As a result, the attention of the following vehicle 12 is caught at an early stage, before the host vehicle 11 arrives at the specific position.

As described thus far, according to the present embodiment, the specific travel conditions of the host vehicle 11 that can lead to a rear-end collision are learned using the following vehicle data acquiring unit 51 and the position data acquiring unit 53, and are stored as a database. Additionally, according to the present embodiment, the specific positions of the host vehicle 11 where a rear-end collision is likely to occur are learned using the following vehicle data acquiring unit 51 and the position data acquiring unit 53, and are stored as a database.

The travel conditions of the host vehicle 11 that can lead to a rear-end collision are often similar. In other words, driving conditions where the host vehicle 11 is about to be struck by the following vehicle 12 and the driver of the host vehicle 11 is frightened as a result are often similar.

Likewise, positions where rear-end collisions are more likely to occur are often similar. In other words, the places and surrounding environments where the host vehicle 11 is about to be rear-ended by the following vehicle 12 and the driver of the host vehicle 11 is frightened as a result are often similar.

According to the present embodiment, states in which a rear-end collision is likely to occur are learned, and those states are stored as a database. That is, a way of driving the host vehicle 11 that can lead to a rear-end collision, known as dangerous driving, a driver of the host vehicle 11 who may cause a rear-end collision, known as a dangerous driver, and places where rear-end collisions are likely to occur, known as dangerous slopes, dangerous curves, and dangerous intersections, are specified through learning and stored as databases.

Using the constructed databases, the warning data is outputted from the host vehicle 11 to the following vehicle 12 in the case where the host vehicle 11 is traveling under travel conditions in which a rear-end collision is likely to occur, the host vehicle 11 approaches a position where a rear-end collision is likely to occur, and the like. As a result, the driver of the following vehicle 12 can take actions to avoid colliding with the host vehicle 11.

In the present embodiment, situations in which the driver of the host vehicle 11 will be frightened are learned and stored as a database, and after the database has been constructed, a warning is issued from the host vehicle 11 to the following vehicle 12 when a situation where the driver of the host vehicle 11 will be frightened is encountered. As a result, collisions between the host vehicle 11 and the following vehicle 12 can be avoided by making use of past frightening situations.

In the present embodiment, the following vehicle data, and one or both of the travel data and position data, are used to construct the database. The highly-accurate databases for avoiding rear-end collisions are thus constructed. On the other hand, the following vehicle data is not used, and one or both of the travel data and the position data are used, when determining the possibility of a collision and outputting the warning data. In other words, the following vehicle sensor 31 is used when the databases are being constructed, but the following vehicle sensor 31 is not used when the database is being used. As a result, a warning can be issued early on the basis of one or both of the travel data and position data of the host vehicle 11, regardless of whether or not the following vehicle 12 is present, or regardless of whether or not the following vehicle 12 is present in the detection area of the following vehicle sensor 31. This makes it possible to prevent rear-end collisions with a high level of reliability.

Additionally, in the present embodiment, the distribution unit 26 that distributes the specific position data to other vehicles is provided in the host vehicle 11. The host vehicle 11 distributes the specific position data to the other vehicles over the communication network 44. In the case where the host vehicle 11 belongs to a transport company such as a freight shipping company, a bus company, or a taxi company, distributing the specific position data acquired by the host vehicle 11 to other vehicles belonging to the transport company makes it possible for the drivers of the other vehicles to drive with caution upon approaching the specific position. Additionally, by sharing the database of the specific position data constructed by the host vehicle 11 with other vehicles and storing that database in the database units 23 of the other vehicles, a richer database is constructed. Furthermore, a database of specific positions constructed by another vehicle may be distributed to the host vehicle 11. Storing the specific position data distributed from another vehicle in the database unit 23 of the host vehicle 11 makes the database unit 23 stored in the database unit 23 of the host vehicle 11 richer. For example, the specific position data of a position the host vehicle 11 has never passed through may be distributed from another vehicle, and that specific position data may be stored in the database unit 23 of the host vehicle 11. Storing both the database of the specific position data constructed by the host vehicle 11 passing through specific positions, and the database of the specific position data constructed by other vehicles passing through specific positions the host vehicle 11 has not passed through, in the database unit 23, makes the database of the specific position data stored in the database unit 23 of the host vehicle 11 richer.

Second Embodiment

A second embodiment will now be described. In the description below, constituent elements identical or substantially similar to those of the above-described embodiments are given the same reference signs, and descriptions thereof are either simplified or omitted.

Figure 16:
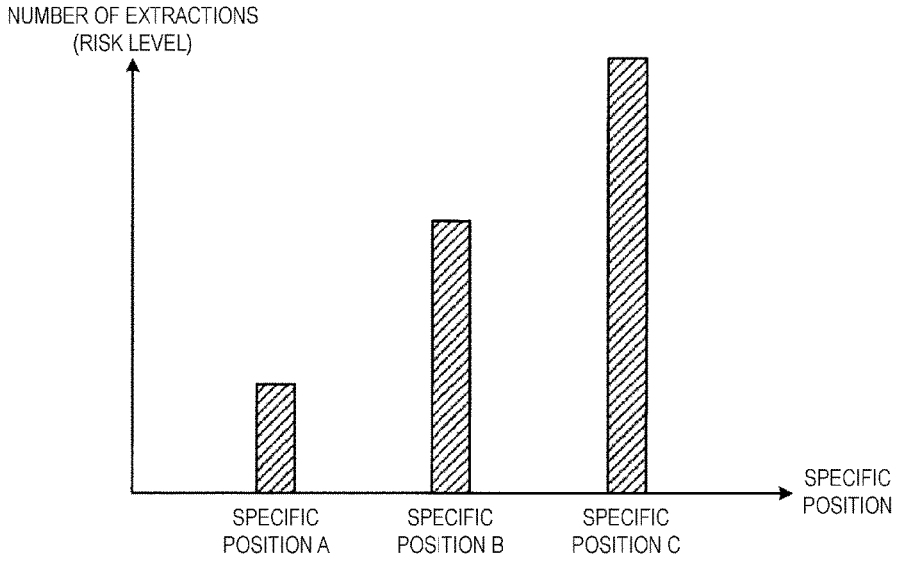
FIG. 16 is a diagram illustrating an example of a collision avoidance method according to a second embodiment.

FIG. 16 is a diagram illustrating an example of operations of the collision avoidance system 100 according to the present embodiment. FIG. 16 is a diagram schematically illustrating a plurality of pieces of specific position data stored in the database unit 23. In the present embodiment, at the database construction stage, the plurality of pieces of specific position data stored in the database unit 23 are classified on the basis of a level of likelihood of a collision, as indicated in FIG. 16. In the example illustrated in FIG. 16, specific position data indicating a specific position A, specific position data indicating a specific position B, and specific position data indicating a specific position C are stored in the database unit 23.

In the present embodiment, the level of likelihood of a collision includes a number of extractions indicating the number of times a specific position of the host vehicle 11 has been extracted by the specific state extraction unit 22 as a specific position where a collision between the host vehicle 11 and the following vehicle 12 is likely to occur. To rephrase, the level of likelihood of a collision is the number of times the specific state extraction unit 22 determined that a collision between the host vehicle 11 and the following vehicle 12 is likely to occur at the same position (that is, the number of extractions), at the database construction stage.

For example, in the case where the host vehicle 11 is a route-based delivery vehicle, the host vehicle 11 is highly likely to pass through the same position (the same traffic signal, the same intersection, or the like) a plurality of times in a set period (each day, each week, each month, or the like). When the host vehicle 11 passes through the same position a plurality of times, the specific state extraction unit 22 determines, on the basis of the following vehicle data acquired by the following vehicle data acquiring unit 51 and the position data acquired by the position data acquiring unit 53, whether or not the position being passed through is a specific position where a collision between the host vehicle 11 and the following vehicle 12 is likely to occur, each time the host vehicle 11 passes through that same position.

The number of times the specific state extraction unit 22 determines a high likelihood of a collision between the host vehicle 11 and the following vehicle 12 may differ depending on the position on the road. For example, at the database construction stage, there are cases where there are positions always determined to have a high likelihood of a collision, and cases where there are positions only sometimes determined to have a high likelihood of a collision.

In the example illustrated in FIG. 16, the level of likelihood of a collision at the three specific positions (the specific position A, the specific position B, and the specific position C) are classified on the basis of the number of extractions of those three specific positions. In the example illustrated in FIG. 16, of the specific position A, the specific position B, and the specific position C, the specific position C has the highest risk level, the specific position B has the next-highest risk level after the specific position C, and the specific position A has the lowest risk level.

In the present embodiment, when using the database, the warning data output unit 25 changes the timing at which the warning data is outputted on the basis of the risk levels of the specific positions stored in the database unit 23.

Figure 17:
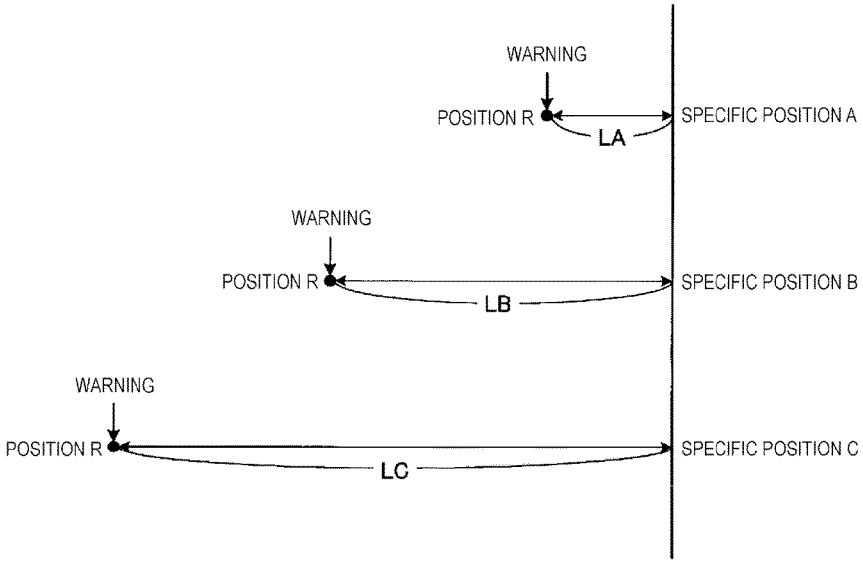
FIG. 17 is a diagram illustrating an example of a collision avoidance method according to the second embodiment.

FIG. 17 is a diagram schematically illustrating the timings at which the warning data is outputted from the warning data output unit 25 on the basis of the risk levels of the specific positions. FIG. 17 illustrates a relationship between a distance from a position R of the host vehicle 11 traveling toward the specific positions (A, B, and C) to the specific positions (A, B, and C) and the timing at which the warning data is outputted from the warning data output unit 25.

As illustrated in FIG. 17, in the case where the host vehicle 11 is traveling toward the specific position C, the warning data output unit 25 outputs the warning data at a timing when the distance between the position R of the host vehicle 11 and the specific position C has reached a distance LC. In the case where the host vehicle 11 is traveling toward the specific position B, the warning data output unit 25 outputs the warning data at a timing when the distance between the position R of the host vehicle 11 and the specific position B has reached a distance LB, which is shorter than the distance LC. In the case where the host vehicle 11 is traveling toward the specific position A, the warning data output unit 25 outputs the warning data at a timing when the distance between the position R of the host vehicle 11 and the specific position A has reached a distance LA, which is shorter than the distance LB. The warning data output unit 25 can determine the position R of the host vehicle 11 on the basis of the position data acquired by the position data acquiring unit 53.

In other words, when the host vehicle 11 travels toward the specific position C, where the risk level is high, the warning data output unit 25 outputs the warning data at a timing at which the host vehicle 11 is sufficiently distant from the specific position C. When the host vehicle 11 travels toward the specific position A, where the risk level is low, the warning data output unit 25 outputs the warning data after the host vehicle 11 has approached the specific position A.

As described thus far, according to the present embodiment, a plurality of pieces of the specific position data are classified on the basis of the risk level, which indicates the level of likelihood of a collision, at the database construction stage. When using the database, the warning data output unit 25 changes the timing at which the warning data is outputted on the basis of the risk levels. As a result, when the host vehicle 11 travels toward the specific position C, where the risk level is high, the warning data is outputted at a timing at which the host vehicle 11 is sufficiently distant from the specific position C. As such, the attention of the driver of the following vehicle 12 can be caught at a timing at which the following vehicle 12 is present in a position far from the specific position C. On the other hand, when the host vehicle 11 travels toward the specific position A, where the risk level is low, the warning data is outputted after the host vehicle 11 has approached the specific position A. As such, a situation in which the warning data is excessively issued to the driver of the following vehicle 12 is suppressed, which suppresses a feeling of annoyance on the part of the driver of the following vehicle 12.

Figure 18:
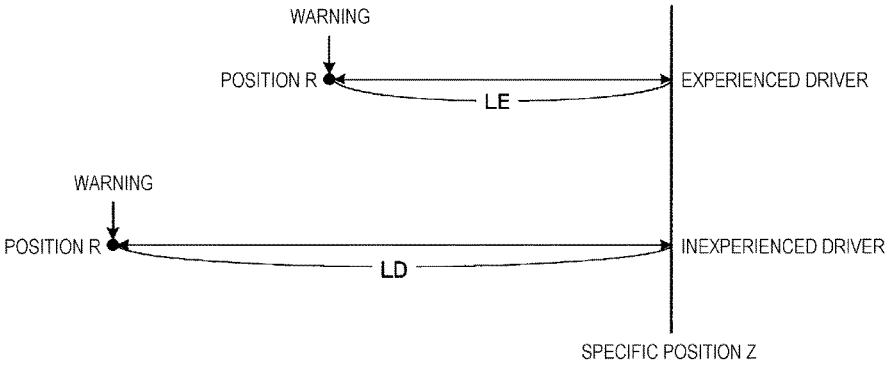
FIG. 18 is a diagram illustrating an example of a collision avoidance method according to the second embodiment.

In the present embodiment, the warning data output unit 25 may change the timing at which to output the warning data on the basis of the driver identification data acquired by the driver identification data acquiring unit 54, as illustrated in FIG. 18. In the case where the host vehicle 11 is a vehicle belonging to a transport company as mentioned above, the single host vehicle 11 may be alternately driven by a plurality of drivers. For example, there are cases where an experienced driver drives the host vehicle 11, and cases where an inexperienced driver drives the host vehicle 11.

FIG. 18 illustrates a relationship between a distance from the position R of the host vehicle to a specific position Z and the timing at which the warning data is outputted from the warning data output unit 25 in the case where the host vehicle 11 is traveling toward the specific position Z, and indicates both a case where the driver of the host vehicle 11 is an experienced driver and a case where the driver of the host vehicle 11 is an inexperienced driver.

As illustrated in FIG. 18, in the case where the host vehicle 11 is traveling toward the specific position Z while being driven by an inexperienced driver, the warning data output unit 25 outputs the warning data at a timing when the distance between the position R of the host vehicle 11 and the specific position Z has reached a distance LD. In the case where the host vehicle 11 is traveling toward the specific position Z while being driven by an experienced driver, the warning data output unit 25 outputs the warning data at a timing when the distance between the position R of the host vehicle 11 and the specific position Z has reached a distance LE, which is shorter than the distance LD.

Even when the host vehicle 11 is traveling toward the same specific position Z, the difference in the driving conditions (a difference in skills) between the experienced driver and the inexperienced driver makes the likelihood of a rear-end collision occurring higher in the case where the inexperienced driver is driving than in the case where the experienced driver is driving. Accordingly, by changing the timing at which the warning data is outputted on the basis of the driver identification data, and outputting the warning data at a timing when the host vehicle 11 is sufficiently distant from the specific position Z in the case where an inexperienced driver is driving, the attention of the driver of the following vehicle 12 can be caught at a timing when the following vehicle 12 is present in a position far from the specific position Z. A collision between the host vehicle 11 and the following vehicle 12 is thus avoided. On the other hand, by outputting the warning data after the host vehicle 11 has approached the specific position Z in the case where an experienced driver is driving, a situation in which the warning data is excessively issued to the driver of the following vehicle 12 is suppressed, which suppresses a feeling of annoyance on the part of the driver of the following vehicle 12.

Figure 19:
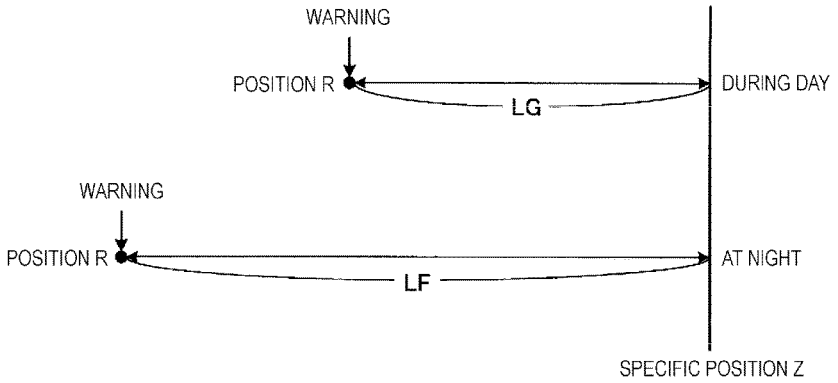
FIG. 19 is a diagram illustrating an example of a collision avoidance method according to the second embodiment.

Additionally, the warning data output unit 25 may change the timing at which to output the warning data on the basis of the time data acquired by the time data acquiring unit 55, as illustrated in FIG. 19. For example, there are cases where the host vehicle 11 travels during the day and cases where the host vehicle 11 travels at night.

FIG. 19 illustrates a relationship between a distance from the position R of the host vehicle to the specific position Z and the timing at which the warning data is outputted from the warning data output unit 25 in the case where the host vehicle 11 is traveling toward the specific position Z, and indicates both a case where the host vehicle 11 is traveling during the day and a case where the host vehicle 11 is traveling at night.

As illustrated in FIG. 19, in the case where the host vehicle 11 is traveling toward the specific position Z at night, the warning data output unit 25 outputs the warning data at a timing when the distance between the position R of the host vehicle 11 and the specific position Z has reached a distance LF. In the case where the host vehicle 11 is traveling toward the specific position Z during the day, the warning data output unit 25 outputs the warning data at a timing when the distance between the position R of the host vehicle 11 and the specific position Z has reached a distance LG, which is shorter than the distance LF.

Even when the host vehicle 11 is traveling toward the same specific position Z, the visibility and the like for the driver makes the likelihood of a rear-end collision occurring higher at night than during the day. Accordingly, by changing the timing at which the warning data is outputted on the basis of the time data, and outputting the warning data at a timing when the host vehicle 11 is sufficiently distant from the specific position Z in the case where the host vehicle 11 is traveling at night, the attention of the driver of the following vehicle 12 can be caught at a timing when the following vehicle 12 is present in a position far from the specific position Z. A collision between the host vehicle 11 and the following vehicle 12 is thus avoided. On the other hand, by outputting the warning data after the host vehicle 11 has approached the specific position Z in the case where the host vehicle 11 is traveling during the day, a situation in which the warning data is excessively issued to the driver of the following vehicle 12 is suppressed, which suppresses a feeling of annoyance on the part of the driver of the following vehicle 12.

Note that the daytime may be classified into a plurality of risk levels on the basis of the time data. For example, the probability of a pedestrian suddenly dashing onto the road is different between the morning rush hour and noon/afternoon. Thus, in the case where the morning rush hour is a time when the host vehicle 11 is more likely to undergo a sudden braking operation or a sudden steering wheel operation, and is thus a time having a higher risk level, the timing at which the warning data is outputted may be varied between the morning and noon/afternoon.

Figure 20:
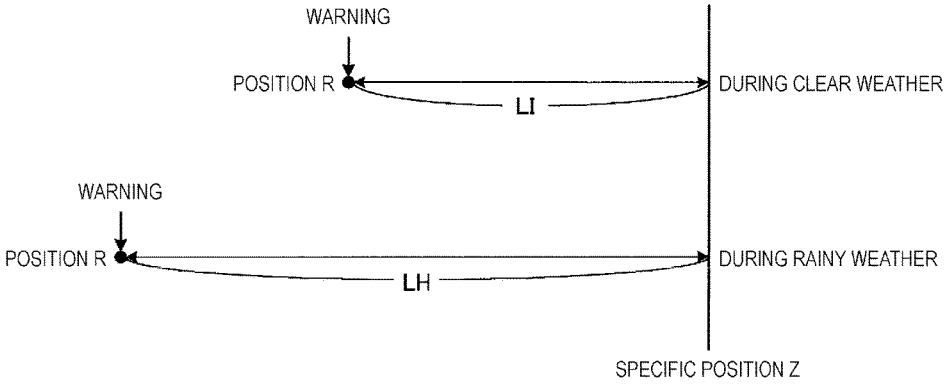
FIG. 20 is a diagram illustrating an example of a collision avoidance method according to the second embodiment.

Additionally, the warning data output unit 25 may change the timing at which to output the warning data on the basis of the weather data acquired by the weather data acquiring unit 56, as illustrated in FIG. 20. For example, there are cases where the host vehicle 11 travels during clear weather and cases where the host vehicle 11 travels during rainy weather.

FIG. 20 illustrates a relationship between a distance from the position R of the host vehicle to the specific position Z and the timing at which the warning data is outputted from the warning data output unit 25 in the case where the host vehicle 11 is traveling toward the specific position Z, and indicates both a case where the host vehicle 11 is traveling during clear weather and a case where the host vehicle 11 is traveling during rainy weather.

As illustrated in FIG. 20, in the case where the host vehicle 11 is traveling toward the specific position Z during rainy weather, the warning data output unit 25 outputs the warning data at a timing when the distance between the position R of the host vehicle 11 and the specific position Z has reached a distance LH. In the case where the host vehicle 11 is traveling toward the specific position Z during clear weather, the warning data output unit 25 outputs the warning data at a timing when the distance between the position R of the host vehicle 11 and the specific position Z has reached a distance LI, which is shorter than the distance LH.

Even when the host vehicle 11 is traveling toward the same specific position Z, changes in the stopping performance of the tires of the following vehicle 12, the visibility for the driver, and the like makes the likelihood of a rear-end collision occurring higher during rainy weather than during clear weather. Accordingly, by changing the timing at which the warning data is outputted on the basis of the weather data, and outputting the warning data at a timing when the host vehicle 11 is sufficiently distant from the specific position Z in the case where the host vehicle 11 is traveling during rainy weather, the attention of the driver of the following vehicle 12 can be caught at a timing when the following vehicle 12 is present in a position far from the specific position Z. A collision between the host vehicle 11 and the following vehicle 12 is thus avoided. On the other hand, by outputting the warning data after the host vehicle 11 has approached the specific position Z in the case where the host vehicle 11 is traveling during clear weather, a situation in which the warning data is excessively issued to the driver of the following vehicle 12 is suppressed, which suppresses a feeling of annoyance on the part of the driver of the following vehicle 12.

Note that in the present embodiment, the database may be constructed under certain predetermined conditions, and that database may then be used. For example, a database including one or both of the specific travel data and the specific position data may be constructed on the basis of the host vehicle 11 being driven by an experienced driver during clear weather and during the day, and that constructed database may be stored in the database unit 23. The warning data output unit 25 may then change the timing at which to output the warning data on the basis of that constructed database and at least one of the driver identification data, the time data, and the weather data.

Third Embodiment

A third embodiment will now be described. In the description below, constituent elements identical or substantially similar to those of the above-described embodiments are given the same reference signs, and descriptions thereof are either simplified or omitted.

Figure 21:
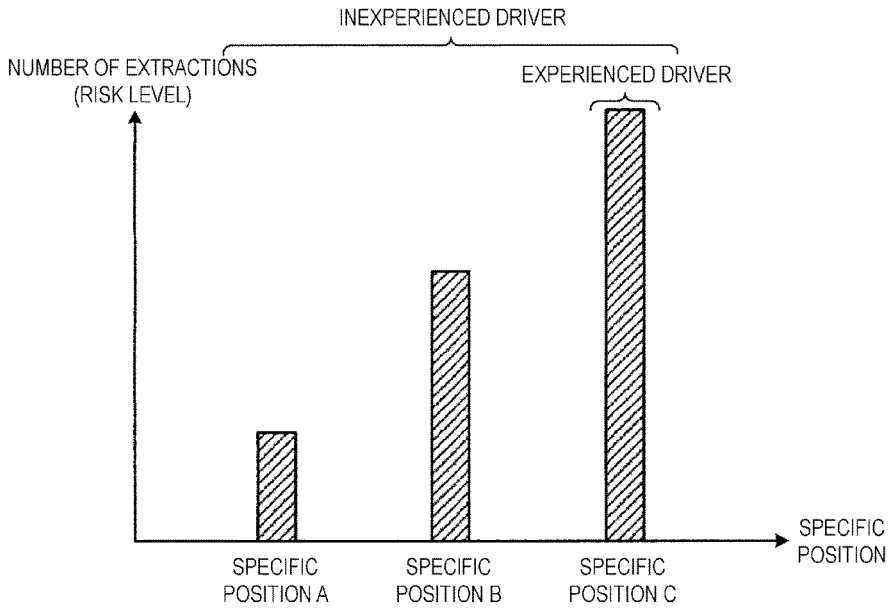
FIG. 21 is a diagram illustrating an example of a collision avoidance method according to a third embodiment.

FIG. 21 is a diagram illustrating an example of operations of the collision avoidance system 100 according to the present embodiment. As in the above-described second embodiment, at the database construction stage, the plurality of pieces of specific position data stored in the database unit 23 are classified on the basis of a level of likelihood of a collision (a risk level). In the example illustrated in FIG. 21, specific position data indicating a specific position A, specific position data indicating a specific position B, and specific position data indicating a specific position C are stored in the database unit 23. Of the specific position A, the specific position B, and the specific position C, the specific position C has the highest risk level, the specific position B has the next-highest risk level after the specific position C, and the specific position A has the lowest risk level.

In the present embodiment, when using the database, the determination unit 24 selects the specific position data to be used in the determination of the possibility of a collision between the host vehicle 11 and the following vehicle 12 from the specific position data having a plurality of risk levels stored in the database unit 23, on the basis of the driver identification data.

For example, in the case where the host vehicle 11 is traveling toward the specific position A, and the driver of the host vehicle 11 is an experienced driver, the determination unit 24 does not determine whether or not a collision between the host vehicle 11 and the following vehicle 12 is possible. The warning data output unit 25 does not output the warning data. Meanwhile, in the case where the host vehicle 11 is traveling toward the specific position B, and the driver of the host vehicle 11 is an experienced driver, the determination unit 24 does not determine whether or not a collision between the host vehicle 11 and the following vehicle 12 is possible. The warning data output unit 25 does not output the warning data. In the case where the host vehicle 11 is traveling toward the specific position C, and the driver of the host vehicle 11 is an experienced driver, the determination unit 24 determines whether or not a collision between the host vehicle 11 and the following vehicle 12 is possible. In the case where the determination unit 24 has determined that a collision is possible, the warning data output unit 25 outputs the warning data.

In the case where the host vehicle 11 is traveling toward the specific position A, and the driver of the host vehicle 11 is an inexperienced driver, the determination unit 24 determines whether or not a collision between the host vehicle 11 and the following vehicle 12 is possible. In the case where the host vehicle 11 is traveling toward the specific position B, and the driver of the host vehicle 11 is an inexperienced driver, the determination unit 24 determines whether or not a collision between the host vehicle 11 and the following vehicle 12 is possible. In the case where the host vehicle 11 is traveling toward the specific position C, and the driver of the host vehicle 11 is an inexperienced driver, the determination unit 24 determines whether or not a collision between the host vehicle 11 and the following vehicle 12 is possible. In the case where the determination unit 24 has determined that a collision is possible, the warning data output unit 25 outputs the warning data.

As such, according to the example described with reference to FIG. 21, the determination unit 24 selects the specific position data indicating the specific position C from the plurality of pieces of specific position data stored in the database unit 23 in the case where the driver is an experienced driver. In the case where the driver is an inexperienced driver, the determination unit 24 selects the specific position data indicating the specific position A, the specific position data indicating the specific position B, and the specific position data indicating the specific position C from the plurality of pieces of specific position data stored in the database unit 23.

For example, even when the host vehicle 11 is traveling toward the specific position A at the same risk level, the difference in the driving conditions (a difference in skills) between the experienced driver and the inexperienced driver makes the likelihood of a rear-end collision occurring higher in the case where the inexperienced driver is driving than in the case where the experienced driver is driving. Accordingly, by selecting the position data used in the determination made by the determination unit 24 on the basis of the driver identification data, the warning data can be outputted and the attention of the driver of the following vehicle 12 can be caught in the case where an inexperienced driver is driving. In the case where an experienced driver is driving, whether or not a collision between the host vehicle 11 and the following vehicle 12 is possible is not determined, and the warning data is not outputted, for specific position data having a low risk level. As a result, a situation in which the warning data is excessively issued to the driver of the following vehicle 12 is suppressed, which suppresses a feeling of annoyance on the part of the driver of the following vehicle 12.

Figure 22:
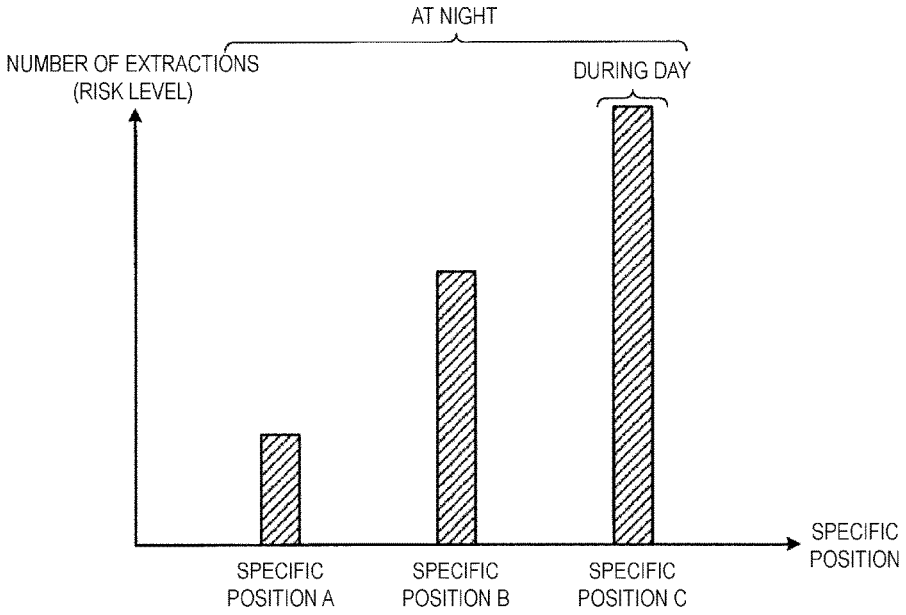
FIG. 22 is a diagram illustrating an example of a collision avoidance method according to the third embodiment.

Meanwhile, the determination unit 24 may select the specific position data to use in the determination from the plurality of pieces of the specific position data stored in the database unit 23 on the basis of the time data acquired by the time data acquiring unit 55, as illustrated in FIG. 22.

In the example illustrated in FIG. 22, when using the database, the determination unit 24 selects the specific position data to be used in the determination of the possibility of a collision between the host vehicle 11 and the following vehicle 12 from the specific position data having a plurality of risk levels stored in the database unit 23, on the basis of the time data.

For example, in the case where the host vehicle 11 is traveling toward the specific position A during the day, the determination unit 24 does not determine whether or not a collision between the host vehicle 11 and the following vehicle 12 is possible. The warning data output unit 25 does not output the warning data. Meanwhile, in the case where the host vehicle 11 is traveling toward the specific position B during the day, the determination unit 24 does not determine whether or not a collision between the host vehicle 11 and the following vehicle 12 is possible. The warning data output unit 25 does not output the warning data. In the case where the host vehicle 11 is traveling toward the specific position C during the day, the determination unit 24 determines whether or not a collision between the host vehicle 11 and the following vehicle 12 is possible. In the case where the determination unit 24 has determined that a collision is possible, the warning data output unit 25 outputs the warning data.

In the case where the host vehicle 11 is traveling toward the specific position A at night, the determination unit 24 determines whether or not a collision between the host vehicle 11 and the following vehicle 12 is possible. In the case where the host vehicle 11 is traveling toward the specific position B at night, the determination unit 24 determines whether or not a collision between the host vehicle 11 and the following vehicle 12 is possible. In the case where the host vehicle 11 is traveling toward the specific position C at night, the determination unit 24 determines whether or not a collision between the host vehicle 11 and the following vehicle 12 is possible. In the case where the determination unit 24 has determined that a collision is possible, the warning data output unit 25 outputs the warning data.

As such, according to the example described with reference to FIG. 22, the determination unit 24 selects the specific position data indicating the specific position C from the plurality of pieces of specific position data stored in the database unit 23 in the case where the host vehicle 11 is traveling during the day. In the case where the host vehicle 11 is traveling at night, the determination unit 24 selects the specific position data indicating the specific position A, the specific position data indicating the specific position B, and the specific position data indicating the specific position C from the plurality of pieces of specific position data stored in the database unit 23.

For example, even when the host vehicle 11 is traveling toward the specific position A at the same risk level, the visibility for the driver makes the likelihood of a rear-end collision occurring higher when traveling at night than when traveling during the day. Accordingly, by selecting the position data used in the determination made by the determination unit 24 on the basis of the time data, the warning data can be outputted and the attention of the driver of the following vehicle 12 can be caught in the case where the vehicles are traveling at night. In the case where the vehicles are traveling during the day, whether or not a collision between the host vehicle 11 and the following vehicle 12 is possible is not determined, and the warning data is not outputted, for specific position data having a low risk level. As a result, a situation in which the warning data is excessively issued to the driver of the following vehicle 12 is suppressed, which suppresses a feeling of annoyance on the part of the driver of the following vehicle 12.

Figure 23:
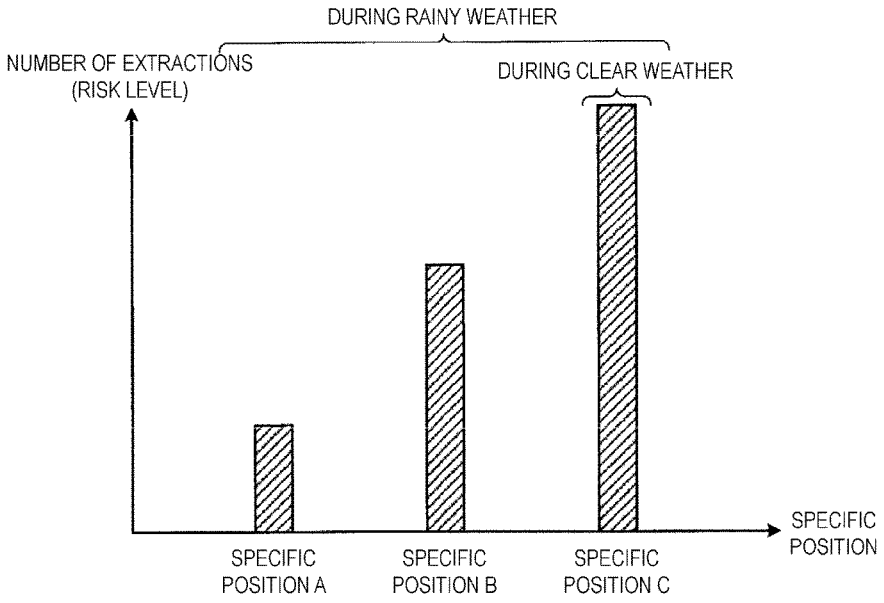
FIG. 23 is a diagram illustrating an example of a collision avoidance method according to the third embodiment.

Meanwhile, the determination unit 24 may select the specific position data to use in the determination from the plurality of pieces of the specific position data stored in the database unit 23 on the basis of the weather data acquired by the weather data acquiring unit 56, as illustrated in FIG. 23.

In the example illustrated in FIG. 23, when using the database, the determination unit 24 selects the specific position data to be used in the determination of the possibility of a collision between the host vehicle 11 and the following vehicle 12 from the specific position data having a plurality of risk levels stored in the database unit 23, on the basis of the weather data.

For example, in the case where the host vehicle 11 is traveling toward the specific position A during clear weather, the determination unit 24 does not determine whether or not a collision between the host vehicle 11 and the following vehicle 12 is possible. The warning data output unit 25 does not output the warning data. Meanwhile, in the case where the host vehicle 11 is traveling toward the specific position B during clear weather, the determination unit 24 does not determine whether or not a collision between the host vehicle 11 and the following vehicle 12 is possible. The warning data output unit 25 does not output the warning data. In the case where the host vehicle 11 is traveling toward the specific position C during clear weather, the determination unit 24 determines whether or not a collision between the host vehicle 11 and the following vehicle 12 is possible. In the case where the determination unit 24 has determined that a collision is possible, the warning data output unit 25 outputs the warning data.

In the case where the host vehicle 11 is traveling toward the specific position A during rainy weather, the determination unit 24 determines whether or not a collision between the host vehicle 11 and the following vehicle 12 is possible. In the case where the host vehicle 11 is traveling toward the specific position B during rainy weather, the determination unit 24 determines whether or not a collision between the host vehicle 11 and the following vehicle 12 is possible. In the case where the host vehicle 11 is traveling toward the specific position C during rainy weather, the determination unit 24 determines whether or not a collision between the host vehicle 11 and the following vehicle 12 is possible. In the case where the determination unit 24 has determined that a collision is possible, the warning data output unit 25 outputs the warning data.

As such, according to the example described with reference to FIG. 23, the determination unit 24 selects the specific position data indicating the specific position C from the plurality of pieces of specific position data stored in the database unit 23 in the case where the host vehicle 11 is traveling during clear weather. In the case where the host vehicle 11 is traveling during rainy weather, the determination unit 24 selects the specific position data indicating the specific position A, the specific position data indicating the specific position B, and the specific position data indicating the specific position C from the plurality of pieces of specific position data stored in the database unit 23.

For example, even when the host vehicle 11 is traveling toward the specific position A at the same risk level, changes in the stopping performance of the tires of the following vehicle 12, the visibility for the driver, and the like makes the likelihood of a rear-end collision occurring higher when traveling during rainy weather than when traveling during clear weather. Accordingly, by selecting the position data used in the determination made by the determination unit 24 on the basis of the weather data, the warning data can be outputted and the attention of the driver of the following vehicle 12 can be caught in the case where the vehicles are traveling during rainy weather. In the case where the vehicles are traveling during clear weather, whether or not a collision between the host vehicle 11 and the following vehicle 12 is possible is not determined, and the warning data is not outputted, for specific position data having a low risk level. As a result, a situation in which the warning data is excessively issued to the driver of the following vehicle 12 is suppressed, which suppresses a feeling of annoyance on the part of the driver of the following vehicle 12.

Note that in the present embodiment, the database may be constructed under certain predetermined conditions, and that database may then be used. For example, a database including one or both of the specific travel data and the specific position data may be constructed on the basis of the host vehicle 11 being driven by an inexperienced driver during rainy weather and at night, and that constructed database may be stored in the database unit 23. The determination unit 24 may then select the specific position data to use in the determination from the plurality of pieces of the specific position data stored in the database unit 23, on the basis of that constructed database and at least one of the driver identification data, the time data, and the weather data.

Note that in the above-described embodiments, a database in which one or both of the specific travel data and the specific position data are associated with the driver identification data may be constructed. For example, in the case where the database is constructed by an experienced driver, the specific travel data or the specific position data may be difficult to extract, whereas in the case where the database is constructed by an inexperienced driver, the specific travel data or the specific position data may be easy to extract. Both a database constructed by an experienced driver and a database constructed by an inexperienced driver may be stored in the database unit 23. Thus, when the databases are used, in the case where the experienced driver uses the databases, the database constructed by the experienced driver may be selected on the basis of the driver identification data. Likewise, in the case where the inexperienced driver uses the databases, the database constructed by the inexperienced driver may be selected on the basis of the driver identification data.

Note that in the above-described embodiments, a database in which one or both of the specific travel data and the specific position data are associated with the time data may be constructed. For example, in the case where the database is constructed during the day, the specific travel data or the specific position data may be difficult to extract, whereas in the case where the database is constructed at night, the specific travel data or the specific position data may be easy to extract. Both a database constructed during the day and a database constructed at night may be stored in the database unit 23. Thus, when the databases are used, in the case where the databases are used during the day, the database constructed during the day may be selected on the basis of the time data. Likewise, in the case where the databases are used at night, the database constructed at night may be selected on the basis of the time data.

Note that in the above-described embodiments, a database in which one or both of the specific travel data and the specific position data are associated with the weather data may be constructed. For example, in the case where the database is constructed during clear weather, the specific travel data or the specific position data may be difficult to extract, whereas in the case where the database is constructed during rainy weather, the specific travel data or the specific position data may be easy to extract. Both a database constructed during clear weather and a database constructed during rainy weather may be stored in the database unit 23. Thus, when the databases are used, in the case where the databases are used during clear weather, the database constructed during clear weather may be selected on the basis of the weather data. Likewise, in the case where the databases are used during rainy weather, the database constructed during rainy weather may be selected on the basis of the weather data.

The invention claimed is:

1. A collision avoidance system comprising:

a following vehicle data acquiring unit, provided in a host vehicle, that acquires following vehicle data indicating a relative position and a relative speed, relative to the host vehicle, of a following vehicle traveling behind the host vehicle;

a position data acquiring unit, provided in the host vehicle, that acquires position data indicating a position of the host vehicle;

a travel data acquiring unit, provided in the host vehicle, that acquires travel data indicating travel conditions of the host vehicle;

a specific state extraction unit, provided in the host vehicle, that, on a basis of the following vehicle data, the travel data and the position data, extracts specific travel data and specific position data indicating specific travel conditions for the host vehicle under which a possibility of a collision between the host vehicle and the following vehicle is high; wherein the specific state extraction unit, when the relative speed relative to the host vehicle of the following vehicle has become greater than or equal to a predetermined speed and the relative distance relative to the host vehicle of the following vehicle has become less than or equal to a predetermined distance, extracts the specific travel data and the specific position data, and classifies a level of the possibility of the collision on the basis of the number of extractions of the specific travel data and the specific position data;

a database unit, provided in the host vehicle, that stores a plurality of pieces of the specific travel data, the specific position data and the level of the possibility of the collision in association with each other;

a determination unit, provided in the host vehicle, that, on a basis of the travel data acquired by the travel data acquiring unit and the position data acquired by the position data acquiring unit, and the specific travel data and the specific position data stored in the database unit, determines whether or not there is the possibility of the collision between the host vehicle and the following vehicle;

a warning data output unit, provided in the host vehicle, that outputs warning data to the following vehicle upon the determination unit determining that there is the possibility of the collision; wherein the warning data output unit changes a timing at which to output the warning data on the basis of the level of the possibility of the collision; and a distribution unit, provided in the host vehicle, that distributes the specific travel data, the specific position data and the level of the possibility of the collision to another vehicle.

2. The collision avoidance system according to claim 1, further comprising:

a driver identification data acquiring unit, provided in the host vehicle, that acquires driver identification data indicating a driver of the host vehicle;

a time data acquiring unit, provided in the host vehicle, that acquires time data indicating a time; and a weather data acquiring unit, provided in the host vehicle, that acquires weather data indicating the weather, wherein the warning data output unit changes a timing at which to output the warning data on a basis of at least one of the driver identification data, the time data, and the weather data.

3. The collision avoidance system according to claim 1, wherein a plurality of pieces of specific position data stored in the database unit are classified on a basis of a level of the possibility of the collision, the collision avoidance system further comprises:

a driver identification data acquiring unit, provided in the host vehicle, that acquires driver identification data indicating a driver of the host vehicle;

a time data acquiring unit, provided in the host vehicle, that acquires time data indicating a time; and a weather data acquiring unit, provided in the host vehicle, that acquires weather data indicating the weather, and on a basis of at least one of the driver identification data, the time data, and the weather data, the determination unit selects the specific position data to use in the determination from the plurality of pieces of the specific position data stored in the database unit.

* * * * *